US007221326B2

(12) United States Patent
Ida et al.

(10) Patent No.: US 7,221,326 B2
(45) Date of Patent: May 22, 2007

(54) BICONICAL ANTENNA

(75) Inventors: Shogo Ida, Shiga (JP); Daisuke Muto, Shiga (JP)

(73) Assignee: Git Japan, Inc., Shiga (JP)

( * ) Notice: Subject to any disclaimer, the term of this patent is extended or adjusted under 35 U.S.C. 154(b) by 22 days.

(21) Appl. No.: 11/185,498

(22) Filed: Jul. 20, 2005

(65) Prior Publication Data

US 2006/0022885 A1 Feb. 2, 2006

(30) Foreign Application Priority Data

Jul. 27, 2004 (JP) ..... 2004-218229
Jul. 27, 2004 (JP) ..... 2004-218431

(51) Int. Cl.
*H01Q 13/00* (2006.01)

(52) U.S. Cl. ..... 343/773

(58) Field of Classification Search ..... 343/773, 343/774, 725, 700 MS, 908, 810–816, 829–830
See application file for complete search history.

(56) References Cited

U.S. PATENT DOCUMENTS 3,942,180 A * 3/1976 Rannou et al. ..... 343/725
4,608,572 A * 8/1986 Blakney et al. ..... 343/792.5
5,523,767 A * 6/1996 McCorkle ..... 343/810
5,600,331 A * 2/1997 Buralli ..... 343/700 MS
6,052,889 A * 4/2000 Yu et al. ..... 29/600
6,972,726 B2 * 12/2005 Sato et al. ..... 343/725
7,087,530 B2 * 8/2006 Motonari et al. ..... 438/693

FOREIGN PATENT DOCUMENTS

JP H09-008550 10/1997
JP A2001-185942 6/2001

* cited by examiner

*Primary Examiner*—Hoanganh Le
*Assistant Examiner*—Huedung Mancuso
(74) *Attorney, Agent, or Firm*—Steptoe & Johnson LLP; Tyson York Winarski

(57) ABSTRACT

A biconical antenna according to the present invention includes a columnar dielectric member having frustum-shaped cavities extending respectively from an upper surface and a lower surface toward a center of the columnar dielectric member, wherein flat surfaces of apex portions of the frustum-shaped cavities are parallel and in opposition to one another; a frustum-shaped feeder portion made of a conductive film provided on an inner surface of the upper cavity; and a frustum-shaped ground portion made of a conductive film provided on an inner surface of the lower cavity. The present invention realizes a more compact biconical antenna by filling the dielectric member between the feeder portion and the ground portion of the biconical antenna.

6 Claims, 16 Drawing Sheets

BICONICAL ANTENNA

This application claims priority to Patent Application No. 2004-218431 titled "BICONICAL ANTENNA" filed in Japan on Jul. 27, 2004 and Patent Application No. 2004-218229 titled "BICONICAL ANTENNA" filed in Japan on Jul. 27, 2004, the entire contents of which are hereby incorporated by reference.

BACKGROUND OF THE INVENTION

1. Field of the Invention

The present invention relates to non-directional antennas used for broadband communication.

2. Description of the Related Art

In recent years, UWB (ultra wideband) communication, which is a communication technology that uses an extremely wide frequency band, that can coexist with existing wireless technology and that allows high-speed broadband wireless communication, has garnered considerable attention. UWB communication uses a frequency band of 3.1 GHz to 10.6 GHz for short pulses of only about 1 ns duration. It enables high-speed communication by exclusively using an extremely wide frequency band of several GHz width.

On the other hand, the distance over which communication is possible in UWB communication is short. Therefore, it has been proposed to utilize UWB in wireless interfaces to perform data transfer between computers and peripheral devices.

As the antennas used for UWB communication, there are biconical antennas. The structure of such biconical antennas is disclosed in JP 2001-185942A and JP H9-8550A, for example.

As shown in FIG. 11, in an ordinary biconical antenna 40, frustum-shaped metal members 42 and 44 are placed in opposition to each other with a gap G between them. One of these metal members is a feeder portion 42 and the other is a ground portion 44. The feeder portion 42 is connected to the center conductor 30 of a coaxial cable 34, and the ground portion 44 is connected to the shield conductor 32 of the coaxial cable 34. The emission and reception of electromagnetic waves is carried out with the lateral surface (inclined surface) of the feeder portion 42.

When this biconical antenna is used for data transfer between a computer and peripheral devices by UWB communication, then the biconical antenna needs to be attached to the computer, and in particular when attaching it to a notebook computer, there is a need for making the biconical antenna small.

However, as far as the size of the biconical antenna is concerned, the length of the frustum-shaped lead line in the biconical antenna disclosed in JP H9-8550A is 25 cm, which is too large to attach it to a notebook computer. There are no particular statements regarding size in JP 2001-185942A. Furthermore, in JP 2001-185942A and JP H9-8550A, there are no particular statements concerning making the biconical antenna smaller and using it as a wireless interface for computers. Due to their size, it would be difficult to use the conventional biconical antennas disclosed in JP 2001-185942A and JP H9-8550A as a wireless interface for computers. Moreover, as mentioned above, the frequency region for UWB communication is the microwave frequency region. Therefore, a considerable precision is required when manufacturing the antenna 40. Also, if there are discrepancies in shape or dimensions of the antenna 40 during the manufacturing the antenna, or if there are scratches or the like on the surface of the antenna 40, then the antenna characteristics will change. Therefore, an extremely high precision is required in the manufacturing process of the biconical antenna 40 when trimming the frustum-shaped metal or when assembling the biconical antenna 40.

SUMMARY OF THE INVENTION

Accordingly, the present invention provides a biconical antenna, which is made so small and light that it can be used as a wireless interface for computers or the like, and which is manufactured with high precision.

The present invention has the following features.

That is to say, a biconical antenna in accordance with the present invention comprises:

a columnar dielectric member having frustum-shaped cavities extending respectively from an upper surface and a lower surface toward a center of the columnar dielectric member, wherein flat surfaces of apex portions of the frustum-shaped cavities (also referred to in the following as "cavity apex portion") are arranged parallel and in opposition to one another;

a frustum-shaped feeder portion made of a conductive film provided on an inner surface of the cavity on the upper surface side; and a frustum-shaped ground portion made of a conductive film provided on an inner surface of the cavity on the lower surface side.

In a biconical antenna with this configuration, a dielectric member is filled between a feeder portion and a ground portion. Thus, if the relative permittivity of the filled dielectric member is larger than the relative permittivity of air, then the wavelength of the electromagnetic waves inside the dielectric member become shorter, so that the biconical antenna can be made smaller. The biconical antenna can be made lighter by making the feeder portion and the ground portion by forming a conductive film provided on the inner surface of the frustum-shaped cavities.

It is preferable that the height of the frustum-shaped feeder portion is higher than the height of the frustum-shaped ground portion. This is because it has been found through various simulations, that when the height of the frustum shaped of the feeder portion is higher than the height of the frustum shape of the ground portion, then the diameter of the columnar shape can be made smaller, which is suitable for making the biconical antenna more compact.

Furthermore, it is preferable that a biconical antenna in which the height of the frustum shaped of the feeder portion is higher than the height of the frustum shape of the ground portion further comprises, in the lower surface, a dielectric member formed in one piece with the columnar dielectric member and having a cylindrical cavity inside; and a ground reinforcement portion provided with a cylindrical cavity and made of a conductive film connected to the ground portion. This is because by making the frustum shape of the feeder portion higher than the frustum shape of the ground portion, the size of the ground portion becomes smaller than the size of the feeder portion, and the portion that the ground portion is smaller can be compensated by the ground reinforcement portion. It is preferable that a cavity is provided at the apex portion of the frustum shape constituting the feeder portion, and that a reflector is provided by forming a conductive film on the inner surface of the cavity.

Furthermore, a biconical antenna may also have a configuration (referred to as "second configuration") such that it comprises a frustum-shaped feeder portion having a flat surface at its apex portion, wherein a conductor is formed at least on its surface; and a frustum-shaped ground portion having a flat surface at its apex portion, wherein a conductor is formed at least on its surface, the ground portion being arranged in opposition to the feeder portion, such that a gap is provided between the flat surfaces; and a dielectric member filling a space between the feeder portion and the ground portion. In this configuration, it is required that the surface of the feeder portion and the ground portion is a conductor, but their inside may also be made of a resin or the like. This is because electromagnetic waves are propagated along the surface of conductors.

In the biconical antenna of the second configuration, the frustum shapes of the feeder portion and the ground portion have the same height.

Moreover, in the biconical antenna of the second configuration, the frustum shape of the feeder portion may also be higher than the frustum shape of the ground portion.

Furthermore, in the biconical antenna of the second configuration, it is also possible to provide a ground reinforcement portion at the bottom surface of the ground portion.

Moreover, in the biconical antenna of the second configuration, it is also possible to provide a disk-shaped reflector at the apex portion of the feeder portion.

Moreover, in the biconical antenna of the second configuration, the diameter of the disk-shaped reflector may depend on a frequency to be cut.

These and other advantages of the present invention will become more apparent from the following detailed description of the present invention when taken in conjunction with the accompanying drawings.

DESCRIPTION OF THE PREFERRED EMBODIMENTS

The following is a description of preferred embodiments of the present invention, with reference to the accompanying drawings.

Figure 1:
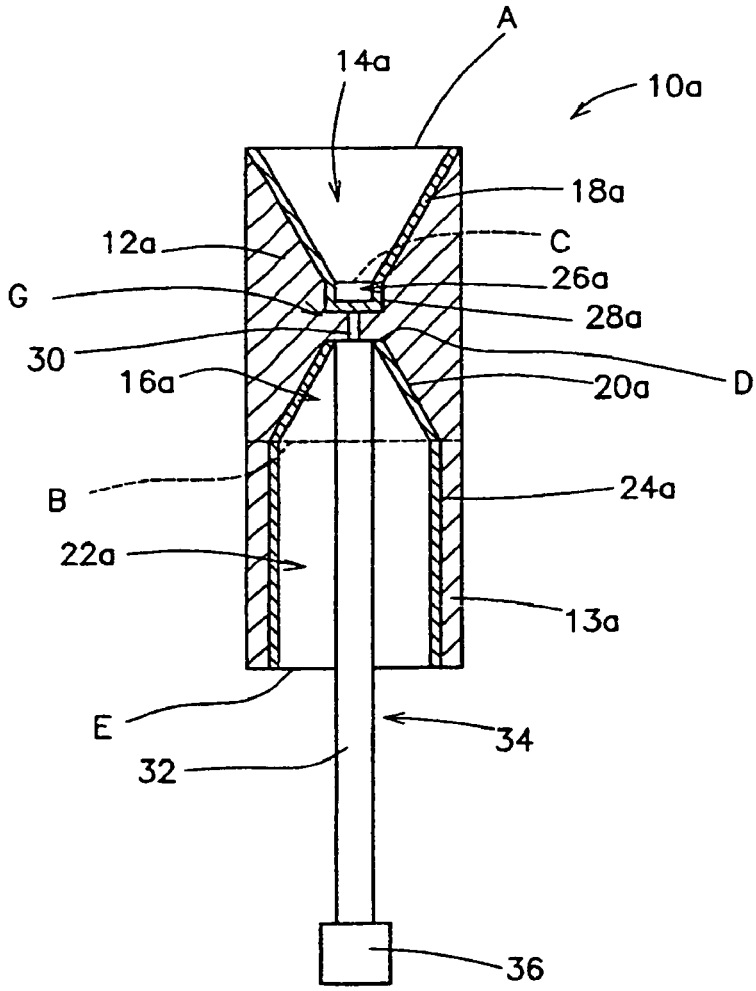
FIG. 1 is a cross-sectional diagram showing the configuration of a biconical antenna according to a first embodiment of the present invention.

FIG. 1 is a cross-sectional diagram showing the configuration of a biconical antenna 10*a* according to a first embodiment of the present invention. This biconical antenna 10*a* includes a dielectric member 12*a* having two frustum-shaped cavities 14*a* and 16*a*, a tubular dielectric member 13*a*, a reflector 28*a*, a coaxial cable 34, a center conductor 30 of the coaxial cable, a shield conductor 32 of the coaxial cable, a connector 36, a feeder portion 18*a*, a ground portion 20*a*, and a ground reinforcement portion 24*a*.

The feeder portion 18*a* is made of a conductive sheet that is arranged on the inner surface of the frustum-shaped cavity that extends from the upper surface A of the columnar dielectric member 12*a* towards the center.

Similarly, the ground portion 20*a* is also made of a conductive sheet that is arranged on the inner surface of the frustum-shaped cavity that extends from the lower surface B of the columnar dielectric member 12*a* towards the center.

Cavities are formed inside the feeder portion 18*a*, the ground portion 20*a* and the ground reinforcement portion 24*a*. The reason for this is that, as noted above, since electromagnetic waves do not enter from the surface of a conductor to its inside for further than a skin thickness δ as given by Equation 1, it is not necessary to fill the inside with a conductor. Thus, by making the inside a cavity, the biconical antenna 10*a* can be made lighter. The conductive sheet is made of copper or gold or the like. The thickness of the sheet is at least δ. For example, it may be at least 0.1 μm.

$$\delta = \frac{1}{\sqrt{\pi \mu f \sigma}} \qquad \text{Equation 1}$$

The reflector 28*a* is made of a conductive film that is formed on the inner surface of a disk-shaped cavity 26*a* that is provided at the apex portion C of the frustum-shaped cavity facing from the upper surface A of the dielectric member 12*a* to the center.

One end of the coaxial cable 34 is inserted through the cavity 16*a* and the cavity 22*a*, and the center conductor 30 is connected to the feeder portion 18*a*, whereas the shield conductor 32 of the coaxial cable is connected to the ground portion 20*a*. The center conductor 30 and the ground portion 20*a* are insulated from one another. The other end of the coaxial cable 34 is connected to the connector 36. With the connector 36, the biconical antenna can be connected to a variety of devices, such as a computer.

The ground reinforcement portion 24*a* is made of a conductive sheet that is formed on the inner surface of the tubular dielectric member 13*a*. The ground reinforcement portion 24*a* is connected to the ground portion 20*a* and is formed in one piece therewith, and functions as a ground portion of the biconical antenna.

The dielectric member 12*a* has two frustum-shaped cavities, and the feeder portion 18*a* as well as the ground portion 20*a* are formed in these cavities. As a result, the space between the feeder portion 18*a* and the ground portion 20*a* is filled with by dielectric member 12*a*. It should be noted that the space between the feeder portion 18*a* and the ground portion 20*a* means not only the space between the apex portions of the feeder portion 18*a* and the ground portion 20*a*, but also the space between the inclined surfaces of the feeder portion 18*a* and the ground portion 20*a*. The relative permittivity of the dielectric member 12*a* is higher than the relative permittivity of air, so that the wavelength of electromagnetic waves within the biconical antenna can be made short, and the biconical antenna 10*a* can be made small, as mentioned above. As the material of the dielectric member 12*a*, it is preferable to use epoxy resin. The reason for this is that as a result of simulating the VSWR (voltage standing wave ratio) characteristics of the biconical antenna, it was found that the relative permittivity is suitably in the range of 3.0 to 4.0, and within this range particularly favorable results were attained at a relative permittivity of 3.6, and the relative permittivity of epoxy resin is 3.6. It should be noted, however, that other resins may also be used, if their relative permittivity is about the same. Furthermore, a material whose relative permittivity is in the range of 3.0 to 4.0 is preferable, but as long as the relative permittivity is larger than 1, the effect that the size of the biconical antenna can be made small is attained.

The following is an example of the shape of the biconical antenna 10a. The diameters of the apex portion C and the bottom portion A of the feeder portion 18*a* are 2.8 mm and 11.0 mm, respectively. The height of the feeder portion 18*a* is 8.0 mm. The diameters of the apex portion D and the bottom portion B of the ground portion 20*a* are 2.8 mm and 9.4 mm, respectively. The height of the ground portion 20*a* is 5.0 mm. The diameter and the height of the reflector 28*a* are 2.8 mm and 1.0 mm, respectively. The diameter and the height of the ground reinforcement portion 24*a* are 9.4 mm and 13.0 mm respectively. The gap G between the feeder portion 18*a* and the ground portion 20*a* is 2.8 mm.

The following is a discussion of the simulation result of the VSWR characteristics of this biconical antenna 10*a*.

Figure 2:
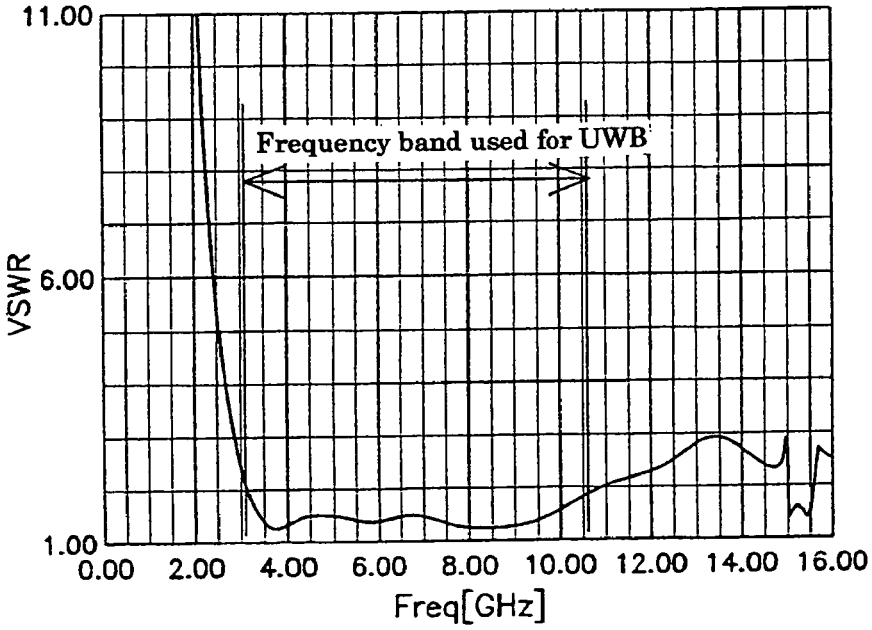
FIG. 2 is a graph showing the simulation result of the Voltage Standing Wave Radio (VSWR) characteristics for the biconical antenna 10*a* according to the first embodiment of the present invention.

FIG. 2 is a graph showing the simulation result of the VSWR characteristics of the biconical antenna 10*a* having a shape as given in the above example. As the simulator, an HFSS by Ansoft Co. was used. In this simulation, the coaxial cable 34 was simulated to be terminated at the lower end E of the ground reinforcement portion 24*a*. As shown in the graph, in the frequency band used for UWB, the VSWR is not higher than 2. Also, in the frequency band outside the UWB band, the VSWR increases sharply. This shows that when using the biconical antenna 10*a*, the antenna characteristics are favorable only in the frequency region that is used in practice. It should be noted that the closer the VSWR is to 1, the more favorable it is for use as an antenna, but a VSWR of not greater than 2 causes no problems in practice.

The following is a discussion of the simulation results of the VSWR characteristics when the shape or the relative permittivity of the dielectric member 12*a* of the biconical antenna 10*a* are varied. Also here, an HFSS by Ansoft Co. was used as the simulator.

Figure 3:
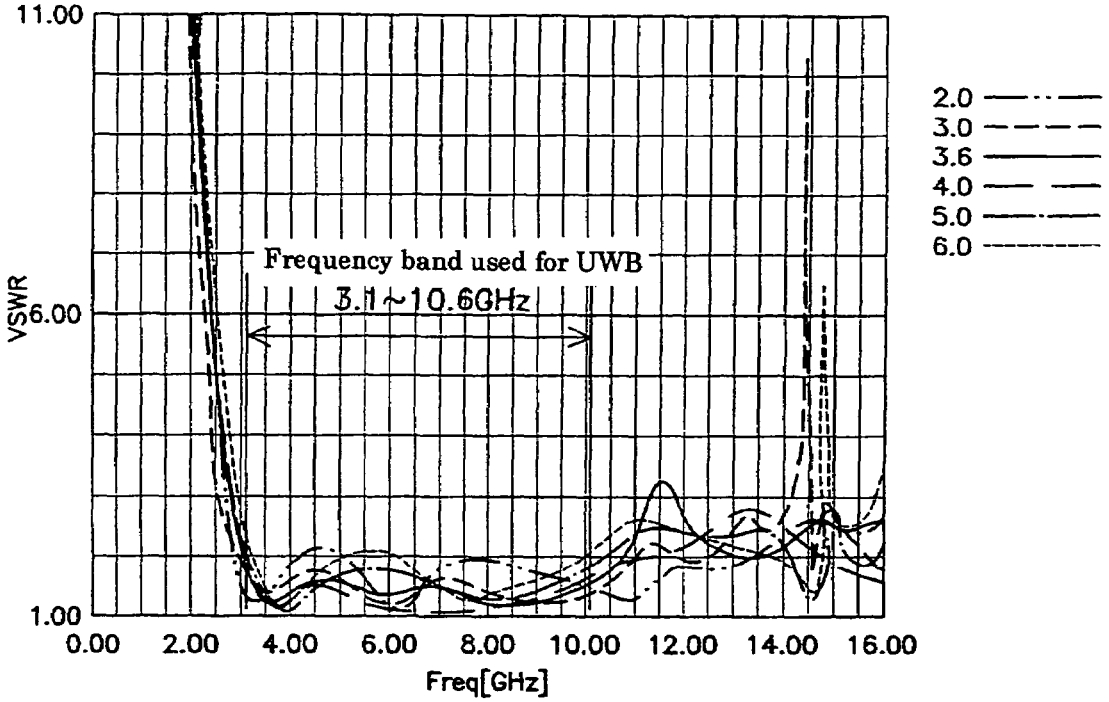
FIG. 3 is a graph showing the simulation results for the case that the relative permittivity of the dielectric member 12*a* of the biconical antenna according to the first embodiment of the present invention was varied between a number of values.

FIG. 3 is a graph showing the simulation results for the case that the relative permittivity of the dielectric member 12*a* of the biconical antenna according to the first embodiment of the present invention is varied between a number of values. This graph shows that the best antenna characteristics are attained when the relative permittivity is 3.6, and favorable antenna characteristics are also attained when the relative permittivity is 3.0 or 4.0.

Figure 4:
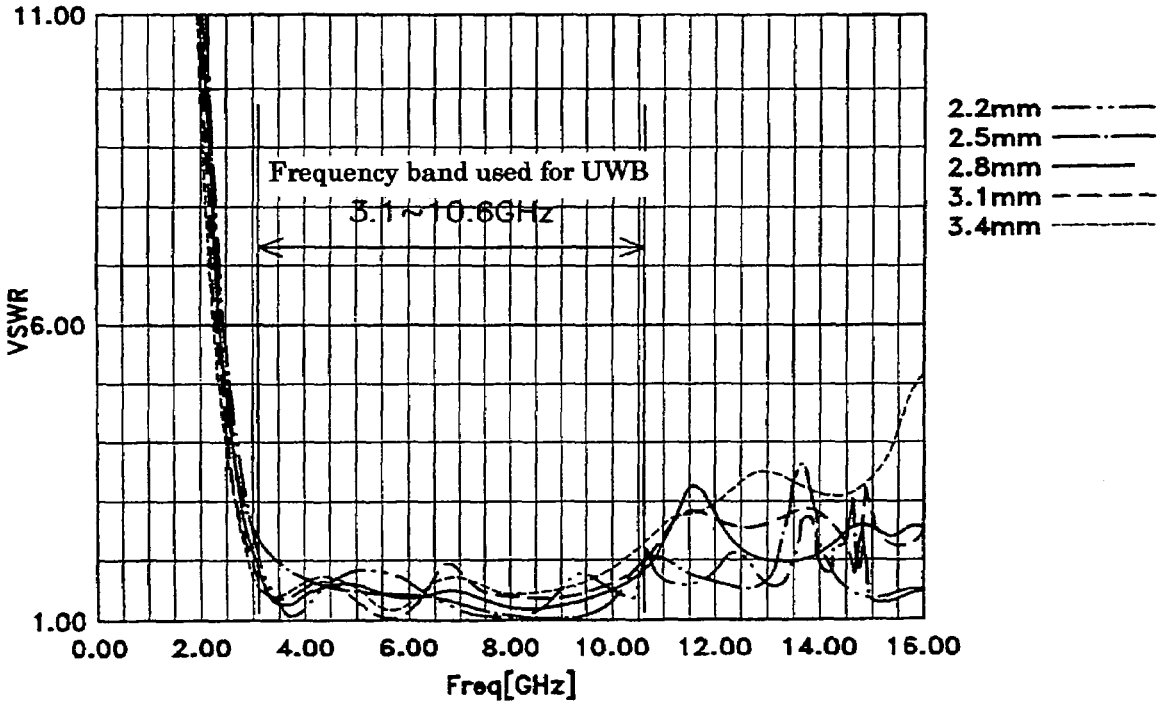
FIG. 4 is a graph showing the simulation results for the case that the height of the gap G between the apex of the feeder portion 18*a* and the apex of the ground portion 20*a* is varied.

FIG. 4 is a graph showing the simulation results for the case that the height of the gap G between the apex portion of the feeder portion 18*a* and the apex portion of the ground portion 20*a* is varied. This graph shows that the best antenna characteristics are attained when the height of the gap G is 2.8 mm, and the antenna characteristics deteriorate when the height of the gap G is higher or lower than 2.8 mm.

Figure 5:
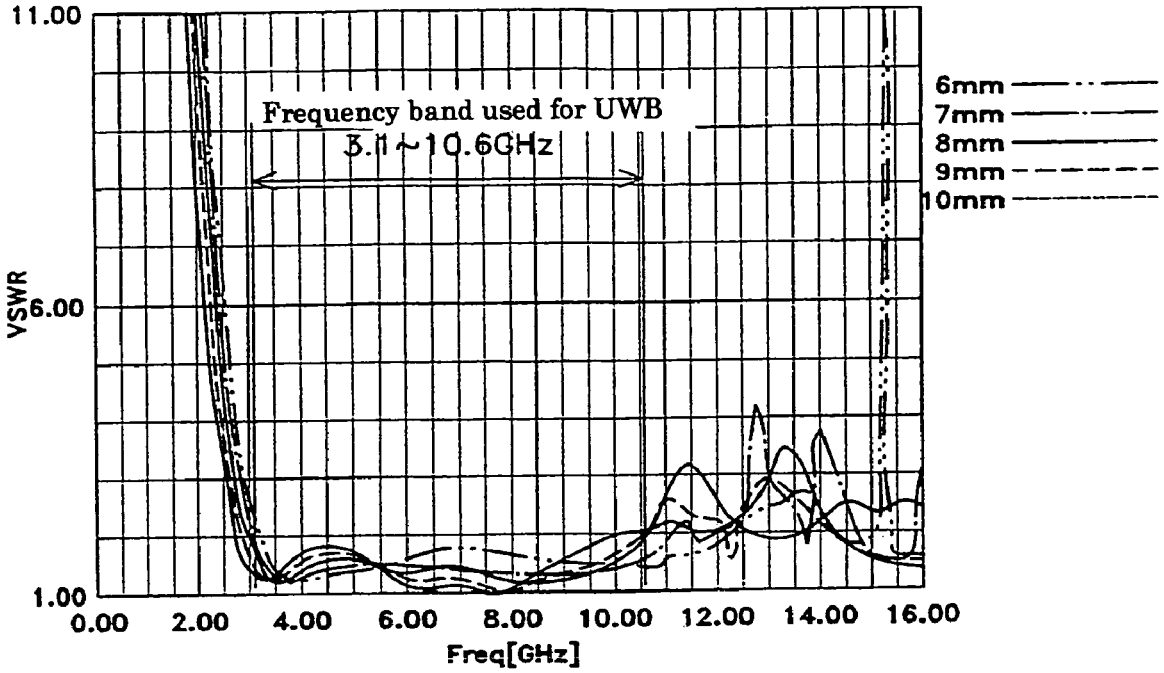
FIG. 5 is a graph showing the simulation results for the case that the height of the feeder portion 18*a* is varied.

FIG. 5 is a graph showing the simulation results for the case that the height of the feeder portion 18*a* is varied. This graph shows that the best antenna characteristics are attained when the height of the feeder portion 18*a* is 8.0 mm. When the height of the feeder portion 18*a* is lower than that, the antenna characteristics deteriorate on the low-frequency side, and when the height of the feeder portion 18*a* is higher than that, the antenna characteristics deteriorate on the high-frequency side.

Figure 6:
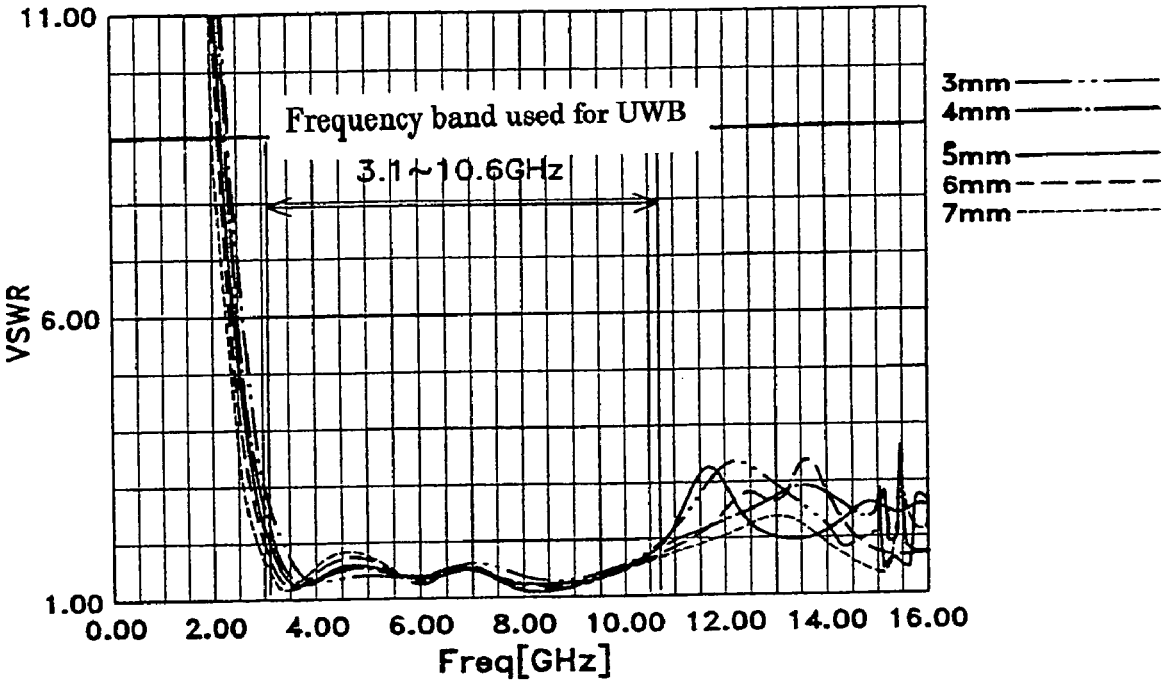
FIG. 6 is a graph showing the simulation results for the case that the height of the ground portion 20*a* is varied.

FIG. 6 is a graph showing the simulation results for the case that the height of the ground portion 20*a* is varied. This graph shows that good antenna characteristics are attained when the height of the ground portion 20*a* is 5 mm or 6 mm, and also at 7 mm, favorable characteristics are maintained. However, in view of making the antenna small, 5 mm are preferable. Also, when the height is made lower than these values, then the antenna characteristics deteriorate on the low-frequency side.

Figure 7:
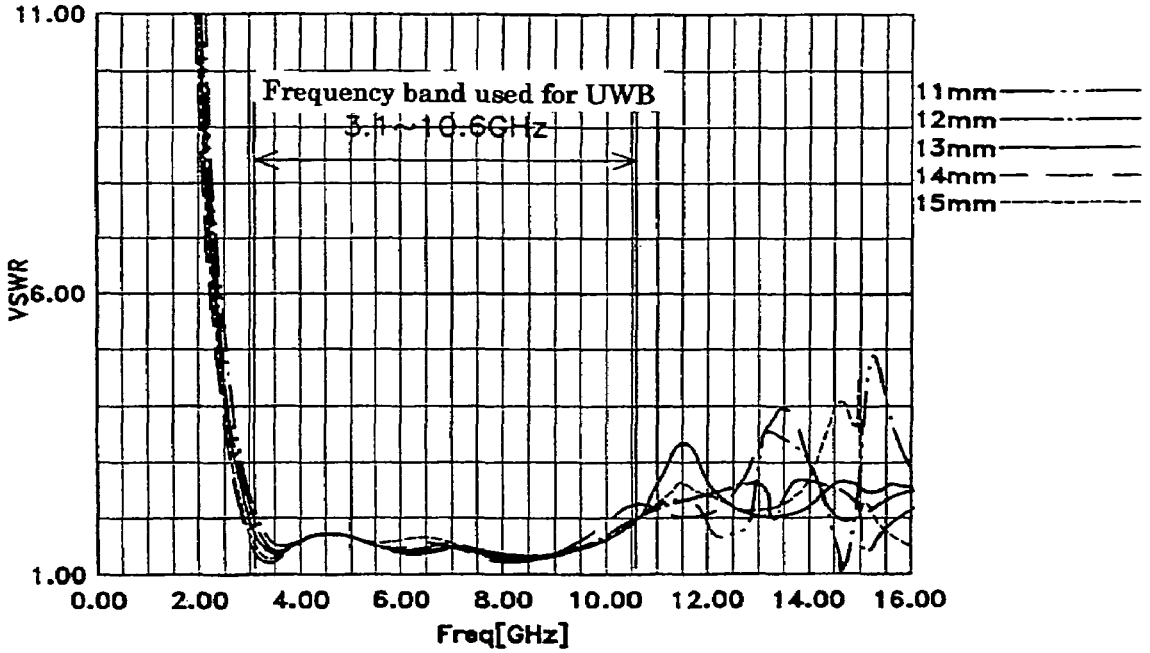
FIG. 7 is a graph showing the simulation results for the case that the height of the tube shape of the ground reinforcement portion 24*a* is varied.

FIG. 7 is a graph showing the simulation results for the case that the height of the tubular ground reinforcement portion 24*a* is varied. This graph shows that the best antenna characteristics are attained when the height of the ground reinforcement portion 24*a* is 13 mm or 15 mm. Also in this case, 13 mm are preferable in view of making the antenna small.

Figure 8:
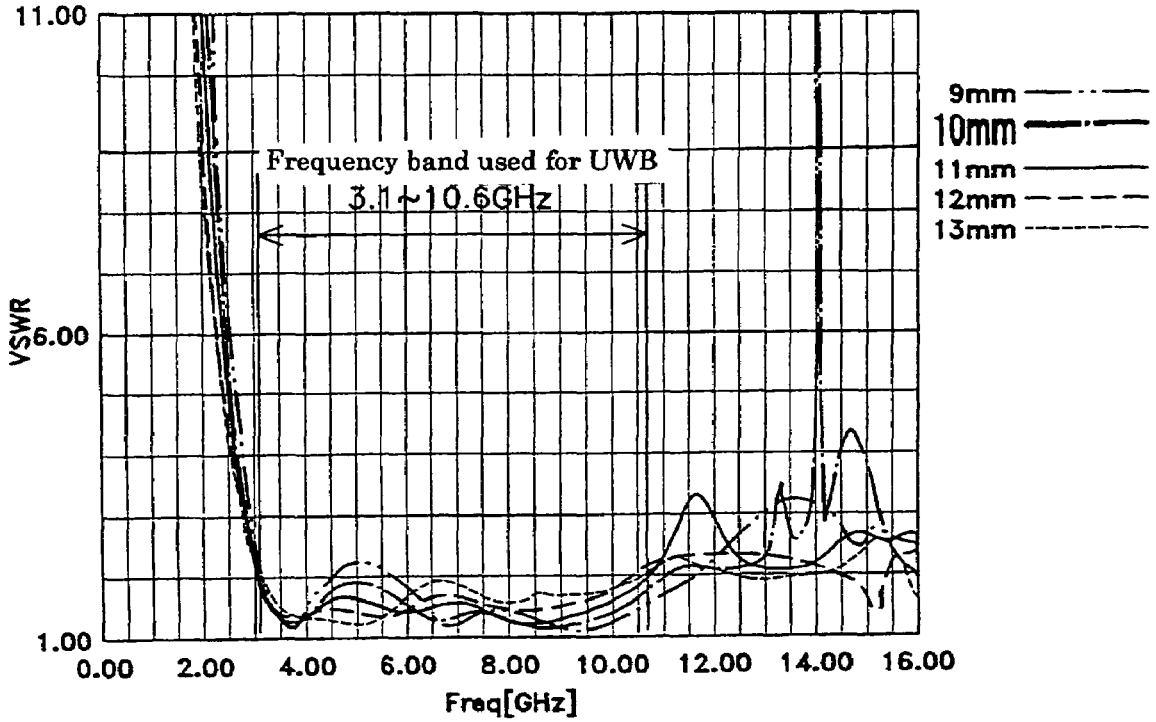
FIG. 8 is a graph showing the simulation results for the case that the width of the biconical antenna 10a, or in other words the diameter of the bottom portion A of the frustum-shape of the feeder portion 18*a* is varied.

FIG. 8 is a graph showing the simulation results for the case that the width of the biconical antenna 10*a*, or in other words the diameter of the bottom portion A of the frustum shape of the feeder portion 18*a* is varied. This graph shows that the best antenna characteristics are attained when the diameter of the bottom portion A of the frustum shape of the feeder portion 18*a* is 11 mm, and also at 10 mm or 12 mm, good antenna characteristics are maintained. However, at 9 mm, the VSWR becomes greater than 2 in the intermediate frequency region, thus deteriorating the antenna characteristics.

Figure 9:
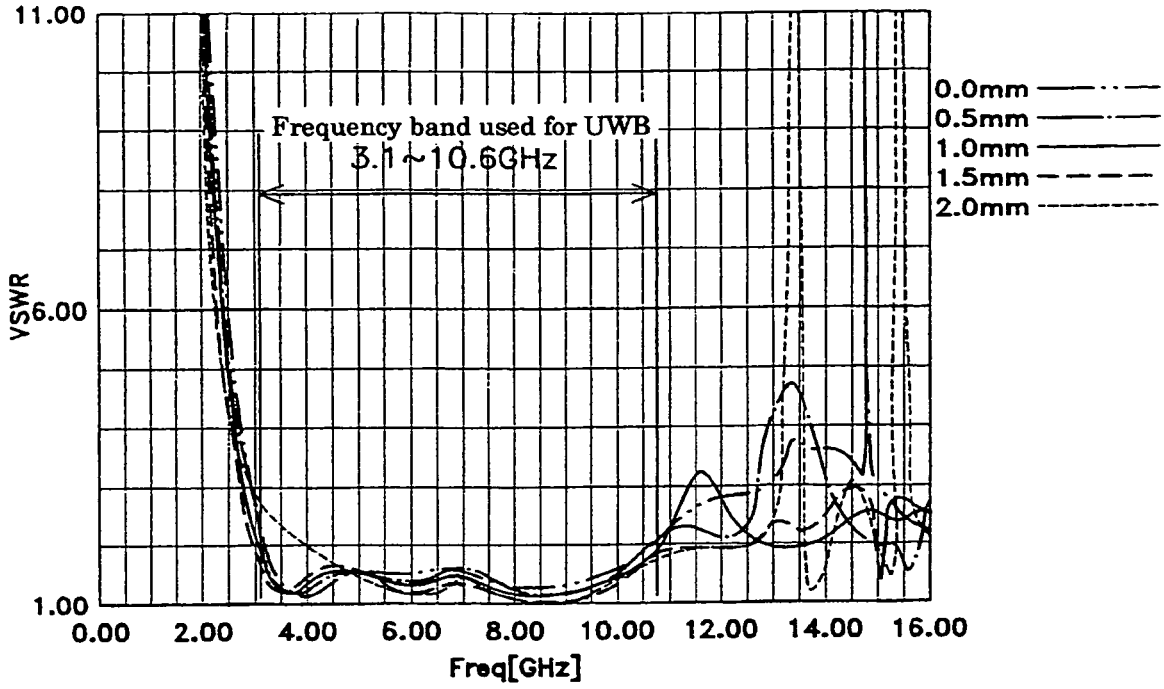
FIG. 9 is a graph showing the simulation results for the case that the height of the reflector 28*a* is varied.

FIG. 9 is a graph showing the simulation results for the case that the height of the reflector 28*a* is varied. This graph shows that good antenna characteristics are attained when the height of the reflector 28*a* is 1.0 mm or 1.5 mm. Also in this case, 1.0 mm are preferable in view of making the antenna small. When the height of the reflector 28*a* becomes too low, the antenna characteristics deteriorate on the high-frequency side, and when the height of the reflector 28*a* becomes too high, the antenna characteristics deteriorate on the low-frequency side.

The following is a description of a method for manufacturing a biconical antenna 10*a* according to an embodiment of the present invention. The biconical antenna 10*a* is made by the following Steps (1) to (4).

Step (1)

Using machining with a lathe in case of small-lot production and using die casting in case of mass production, a columnar dielectric member 12*a* is formed having frustum-shaped cavities from the upper surface A and the lower surface B toward the center. Moreover, the ground reinforcement portion 24*a*, which is formed in one piece with the lower surface B, is formed at the same time.

Step (2)

Using electroless copper plating, a conductive sheet is formed on the inner surface of the cavity 14*a*, the cavity 16*a* and the cavity 22*a*. The upper surface side of this conductive sheet serves as the feeder portion 18*a*, and the lower surface side of this conductive sheet serves as the ground portion 20*a* and the ground reinforcement portion 24*a*. During the electroless copper plating, all portions other than the feeder portion 18*a*, the ground portion 20*a*, and the ground reinforcement portion 24*a* are covered by a lift-off resist. Then, after the electroless copper plating, the lift-off resist is removed, and excess plating at portions other than the feeder portion 18*a*, the ground portion 20*a*, and the ground reinforcement portion 24*a* is removed. Moreover, in electroless copper plating, if the film thickness is too thin, then it is also possible to perform electric copper plating with the formed copper plating as the base. Instead of plating, it is also possible to make the feeder portion 18*a*, the ground portion 20*a*, and the ground reinforcement portion 24*a* from electrodes that are punched out with a punch from a copper plate. Finishing is performed by removing burr and adjusting differences in dimensions as appropriate.

Step (3)

The coaxial cable 34 is inserted from the lower end E of the ground reinforcement portion 24*a* into the cavity 16*a* and the cavity 22*a*. The center conductor 30 of the coaxial cable 34 is connected to the feeder portion 18*a*, and the shield conductor 32 is connected to the ground portion 20*a*.

Step (4)

The connector 36 is attached to the coaxial cable 34. This finishes the biconical antenna 10*a*.

The biconical antenna 10*a* according to this embodiment of the present invention has a feeder portion 18*a* and a ground portion 20*a* made by electroless plating, because the shape of the feeder portion 18*a* etc. can be made with greater precision this way, making this more suitable for the manufacturing method of a high-frequency antenna when using electroless plating than with a manufacturing method in which the feeder portion 18*a* etc. is machined from a conductor. Moreover, electroless plating is better suited for mass production than a manufacturing method in which the feeder portion 18*a* etc. is machined from a conductor.

Moreover, electroless plating is used in Step (2), but it is also possible to form the conductive sheets by vapor deposition of metal. In this case, the feeder portion 18*a* etc. can be formed with high precision, as with plating.

Figure 10:
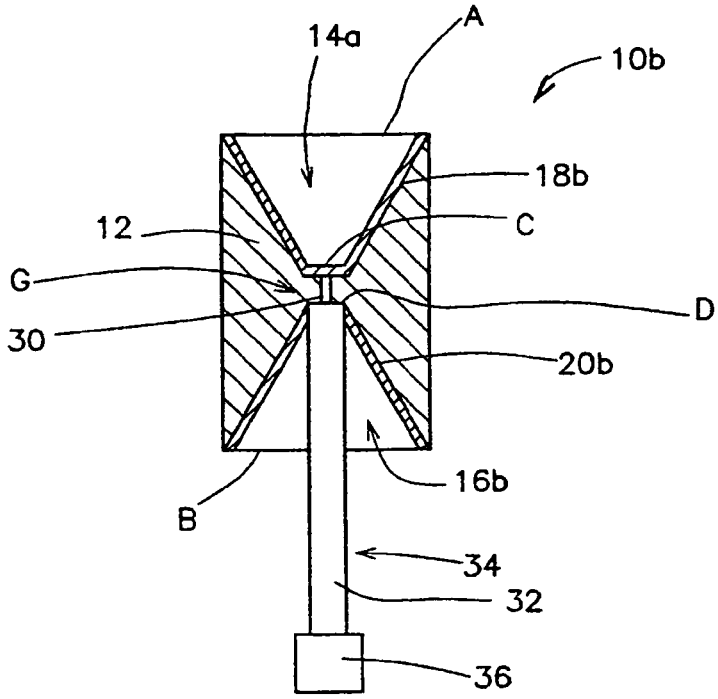
FIG. 10 is a cross-sectional drawing showing the configuration of a biconical antenna in which the shapes of the feeder portion and the ground portion are symmetrical.
Figure 11:
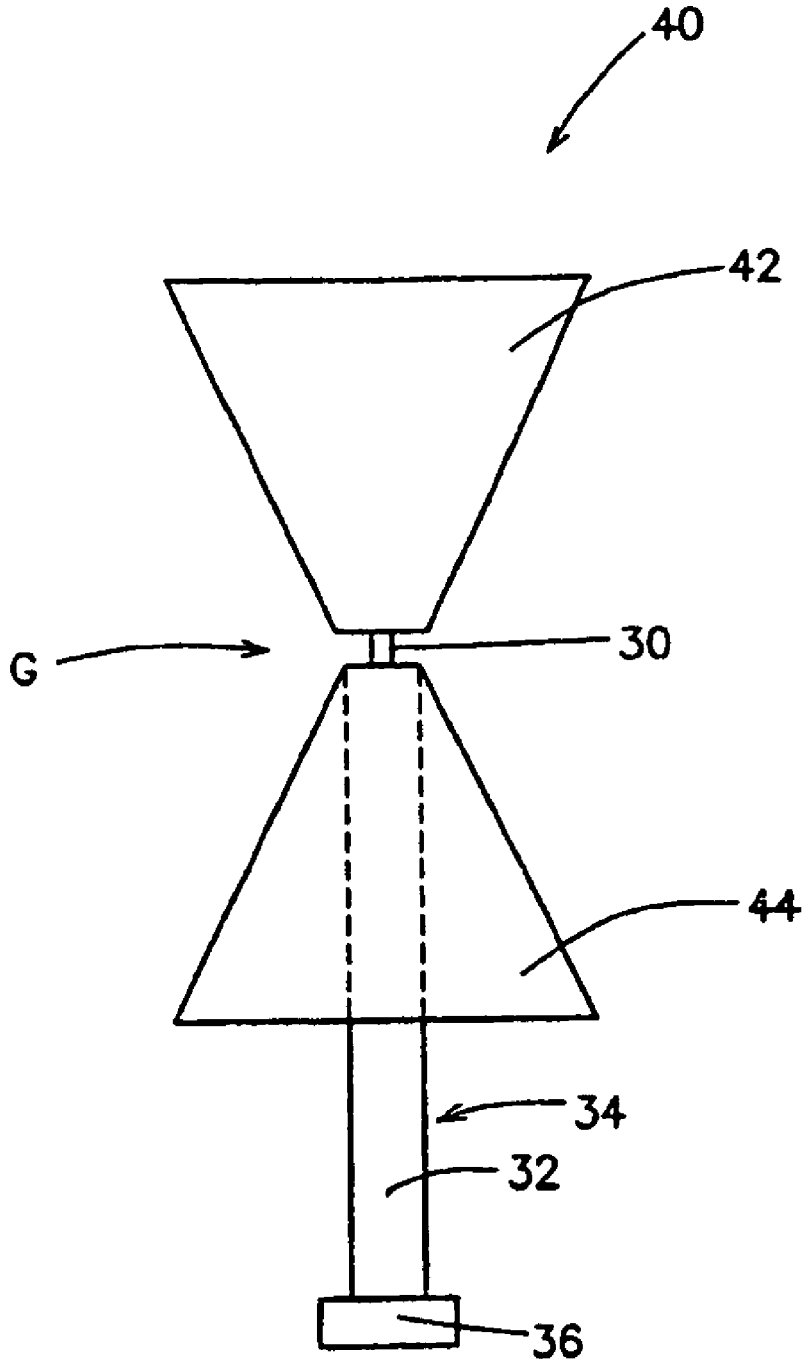
FIG.11 PRIOR ART
FIG. 11 is a cross-sectional view showing the configuration of a conventional biconical antenna.

The foregoing is a description of a biconical antenna 10*a* according to one embodiment of the present invention, but the present invention is not limited to this embodiment. For example, as shown in FIG. 10, it is also possible that the height of the frustum shape of a feeder portion 18*b* and a ground portion 20*b* is the same, so that the biconical antenna has a symmetrical shape. Also in this case, the feeder portion 18*b* and the ground portion 20*b* are formed by conductive sheets, which are formed by electroless copper plating. And also in this case, by forming the feeder portion 18*b* and the ground portion 20*a* by an electroless copper plating step, the biconical antenna can be manufactured with high dimensional precision, and is suitable as an antenna for high-frequency use.

Also, in the biconical antenna 10*a* shown in FIG. 1, the diameter of the reflector 28 a can be varied to various sizes. As a result, it becomes possible to cut specific frequency bands.

Moreover, in the biconical antenna shown in FIG. 10, it is also possible to provide a reflector at the apex portion C of the feeder portion 18*a*, and to vary the diameter of this reflector to various sizes, as in the case of the biconical antenna 10*a* shown in FIG. 1.

Moreover, it is also possible to devise the biconical antenna 10*a* shown in FIG. 1 with a configuration without the reflector 28*a*.

As the material of the dielectric member 12*a*, it is also possible to use other materials, such as alumina, besides epoxy resin. If alumina is used, then Step (1) of the above-described Steps (1) to (4) in the method for manufacturing the biconical antenna becomes a step in which alumina is given into the die having the shape of the dielectric member, and drying and baking is performed.

As shown in FIG. 1, the cavity 14*a* and the cavity 22*a* of the feeder portion 18*a* and the ground portion 20*a* have bottom portions of different size, but they may also have bottom portions of the same size.

The following is a description of a second embodiment of the present invention, with reference to the accompanying drawings.

Figure 12:
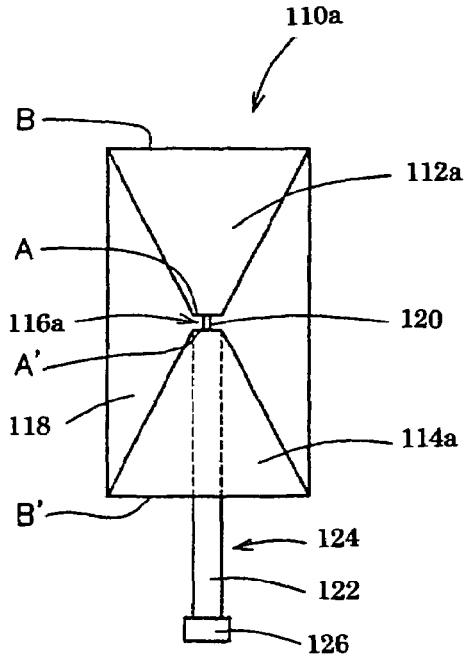
FIG. 12 is a diagram showing the configuration of a biconical antenna 110*a* according to a second embodiment of the present invention.

FIG. 12 is a diagram showing the configuration of a biconical antenna 110*a* according to a second embodiment of the present invention. This biconical antenna 110*a* includes a feeder portion 112*a*, a ground portion 114*a*, a coaxial cable 124, a center conductor 120 of the coaxial cable, a shield conductor 122 of the coaxial cable, and a connector 126.

The feeder portion 112*a* and the ground portion 114*a* both have a frustum shape with apex portions A and A'. The apex portions A and A' oppose each other across a gap 116*a*. The apex portions A and A' and the bottom portions B and B' of the feeder portion 112*a* and the ground portion 114*a* are respectively arranged in parallel. The feeder portion 112*a* and the ground portion 114*a* are made of a conductor, such as copper or the like. It is also possible to make the inside of the feeder portion 112*a* and the ground portion 114*a* of a resin or the like, and to cover the surface with a conductor. This is because the electromagnetic waves are propagated along the skin of the conductor. It should be noted that the same is true for the reflector and the ground reinforcement portion mentioned below, and as long as the surface is made of a conductor, the inside can be made of a resin or the like.

The space between the feeder portion 112*a* and the ground portion 114*a* is filled with a dielectric member 118. That is to say, the apex portions A and A' and the lateral surfaces of the feeder portion 112*a* and the ground portion 114*a* face each other across the dielectric member 118. The feeder portion 112*a*, the ground portion 114*a* and the dielectric member 118 together constitute a columnar shape.

By filling the dielectric member 118 between the feeder portion 112*a* and the ground portion 114*a*, the biconical antenna 110*a* can be made small, as in the first embodiment of the present invention. The reason for this is the same as in the first embodiment. As the material for the dielectric member 118, epoxy resin and alumina or the like are suitable. It should be noted that as shown in FIG. 12, the space between the feeder portion 112*a* and the ground portion 114*a* also includes the space between the inclined surfaces of the frustum shapes.

The coaxial cable 124 includes a center conductor 120 along which signals are propagated, an insulator that covers the center conductor 120, and a shield conductor 122 that covers the insulator. The center conductor 120 and the insulator pass through the center of the ground portion 114*a*, and the center conductor 120 is connected to the apex portion A of the feeder portion 112*a*. Moreover, the shield conductor 122 is connected to the ground portion 114*a*.

The end of the coaxial cable 124 is connected to the connector 126. With the connector 126, the biconical antenna can be connected to various devices.

The foregoing is the basic shape of a biconical antenna according to a second embodiment of the present invention, and the following is an explanation of various variations of this basic shape, based on several working examples.

WORKING EXAMPLE 1

Working Example 1 relates to the case that the feeder portion 112*a* and the ground portion 114*a* have the same frustum shape, as shown in FIG. 12. The feeder portion 112*a* and the ground portion 114*a* have the same frustum shape, and are arranged coaxially but oriented in opposite directions, with the gap 16*a* arranged between them, thus forming a symmetrical shape. The bottom portions B and B' of the frustum shapes both have a diameter of 15 mm, and the diameters of the apex portions A and A' are both 2.4 mm, and their heights are both 13 mm. The apex portions A and A' of the feeder portion 112*a* and the ground portion 114*a* are parallel to one another. The gap 106*a* is 1.5 mm. The relative permittivity of the dielectric member 118 is 3.6.

The following is a discussion of the simulation results for the biconical antenna shown in FIG. 12.

Figure 13:
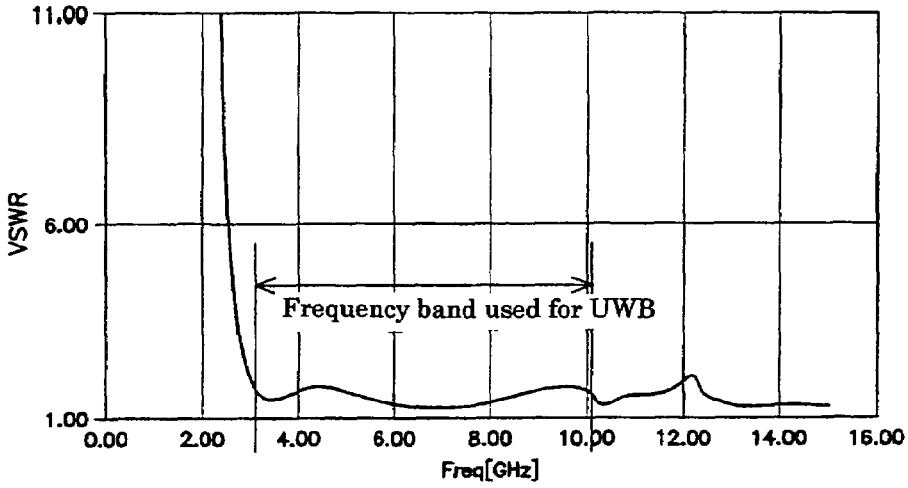
FIG. 13 is a graph showing the simulation result for Working Example 1 of a biconical antenna according to the second embodiment.

FIG. 13 is a graph showing the simulation result for Working Example 1 of a biconical antenna according to the second embodiment. In this simulation, the coaxial cable 124 is set to be terminated at the bottom portion BB' of the ground portion 114*a*. As the simulator, an HFSS by Ansoft Co. was used. According to the simulation result shown in FIG. 13, the VSWR is not greater than 2 in the frequency band of 3.1 GHz to 10.6 GHz that is used for UWB, so that it can be suitably used as an antenna.

Figure 14:
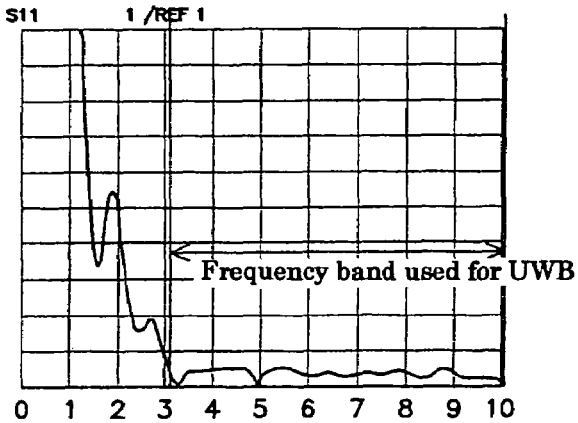
FIG. 14 is a graph showing the VSWR of an actually fabricated biconical antenna according to Working Example 1 of a biconical antenna in accordance with the second embodiment.

FIG. 14 shows the VSWR of an actually fabricated biconical antenna according to Working Example 1 of a biconical antenna in accordance with the second embodiment. However, the length of the coaxial cable 124 is terminated at 30 to 40 mm below the bottom surface BB' of the ground portion 114*a*. As in the result obtained by simulation, the VSWR in the frequency band used for UWB is not greater than 2. Thus, it can be seen that, as in the case of the simulation result, the antenna according to Working Example 1 has favorable antenna characteristics.

Various simulations were carried out, in which the above-described shape was partially modified, and it was confirmed that the above-described shape is the optimal shape. This is discussed in the following.

Figure 15:
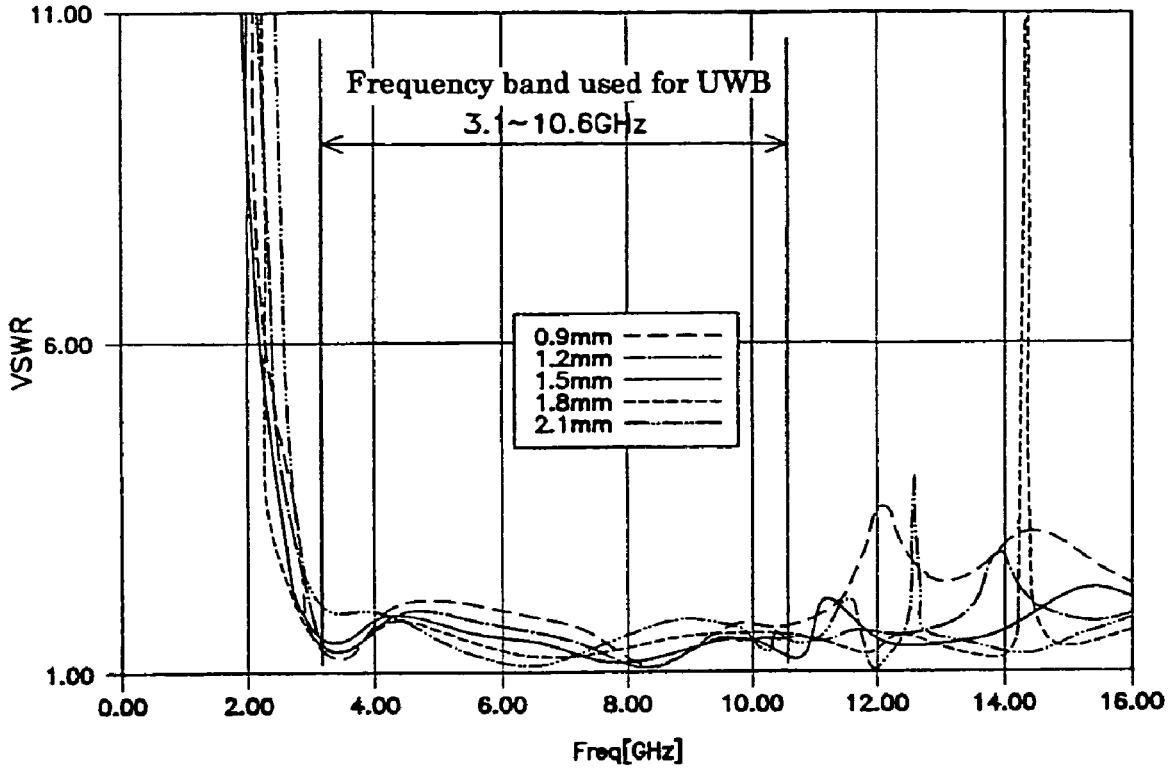
FIG. 15 is a graph showing the VSWR for the case that the gap 116*a* of the biconical antenna 110*a* is varied.

FIG. 15 is a graph showing the VSWR for the case that the gap 116*a* of the biconical antenna 110*a* is varied. When the gap 116*a* is varied, the best results are attained when the gap 116*a* was 1.5 mm, as shown in FIG. 15. Moreover, the results are also favorable when the gap 116*a* is 1.2 mm or 1.8 mm. As a result, it was found that a gap 116*a* of about 1.2 to 1.7 mm is favorable, and when the gap 116*a* is smaller than 1 mm or larger than 2 mm, then the antenna characteristics deteriorate.

Figure 16:
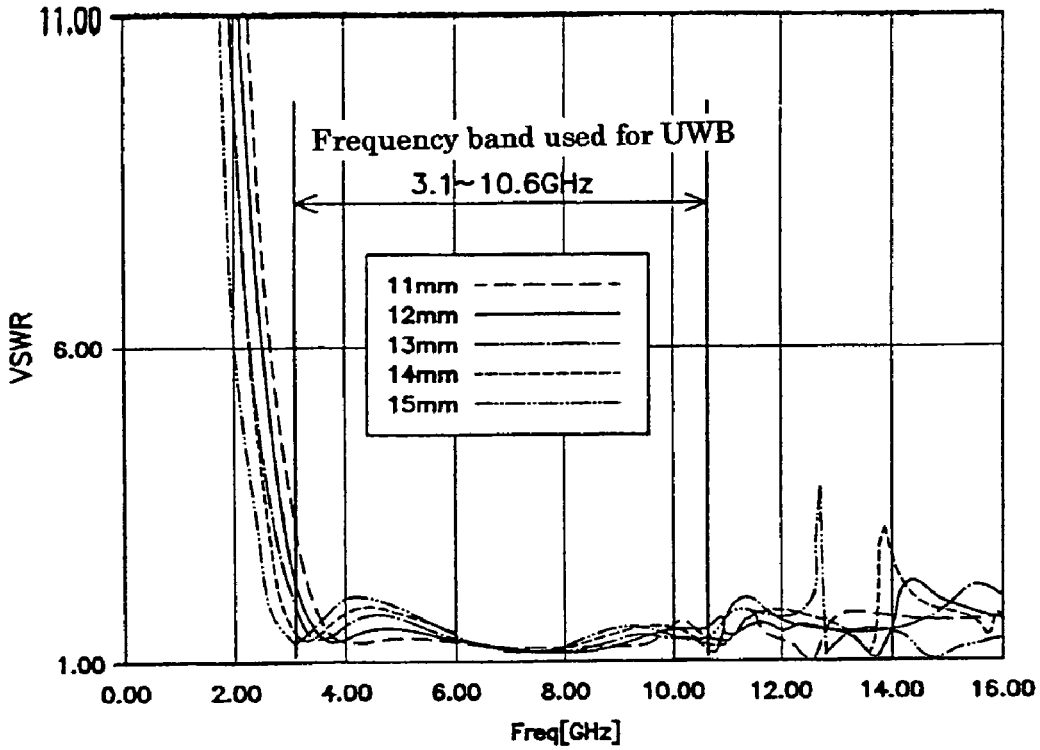
FIG. 16 is a graph showing the VSWR for the case that the height of the frustum shape of the feeder portion 112*a* and the ground portion 114*a* of the biconical antenna 110*a* is varied.

The following is an explanation of the VSWR for the case that the height of the frustum shape of the feeder portion 112*a* and the ground portion 114*a* of the biconical antenna 110*a* is varied. FIG. 16 is a graph showing the VSWR for the case that the height of the frustum shape of the feeder portion 112*a* and the ground portion 114*a* of the biconical antenna 110*a* is varied. Favorable antenna characteristics are attained when the height of the frustum shape of the feeder portion 112*a* and the ground portion 114*a* of the biconical antenna 110*a* is 12 mm or 13 mm. Furthermore, it can be seen that the value of the VSWR changes considerably when this height is changed by 1 mm.

Figure 17:
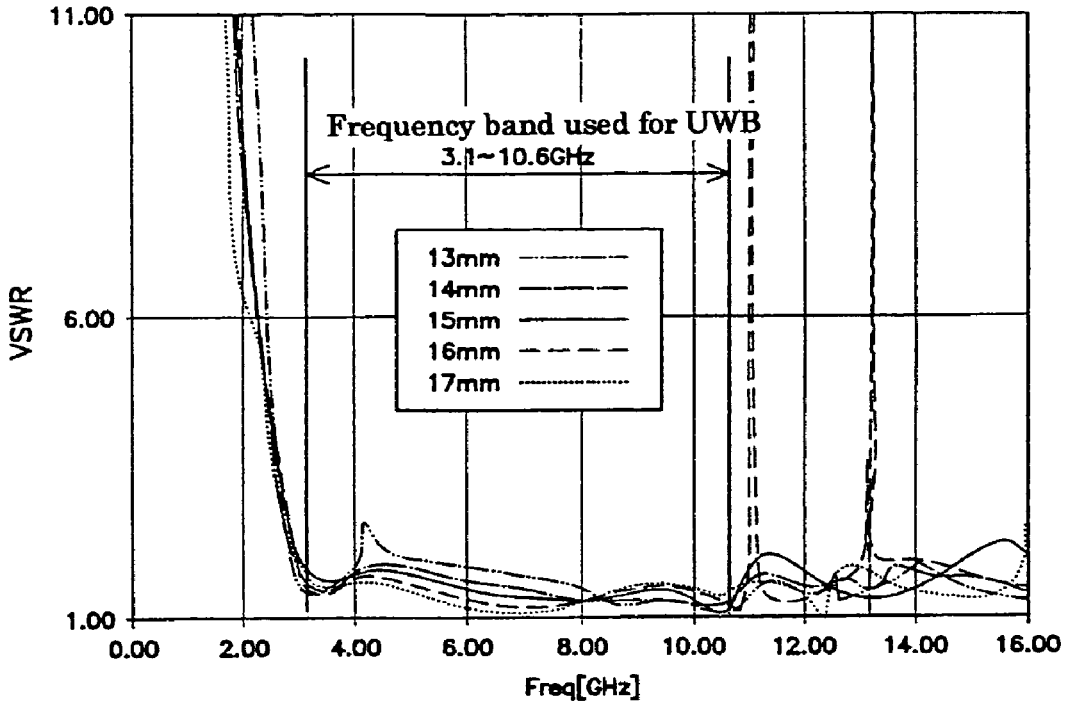
FIG. 17 is a graph showing the VSWR for the case that the width of the biconical antenna, that is, the diameter of the bottom surfaces B and B' of the feeder portion 112*a* and the ground portion 114*a* is varied.

FIG. 17 is a graph showing the VSWR for the case that the width of the biconical antenna, that is, the diameter of the bottom surfaces B and B' of the feeder portion 112*a* and the ground portion 114*a* is varied. It can be seen that the antenna characteristics are favorable when the diameter of the bottom surfaces B and B' is 15 mm to 17 mm. When it is 13 mm, then a frequency region appears in which the antenna characteristics are poor. In view of making the antenna small, 15 mm are best.

Figure 18:
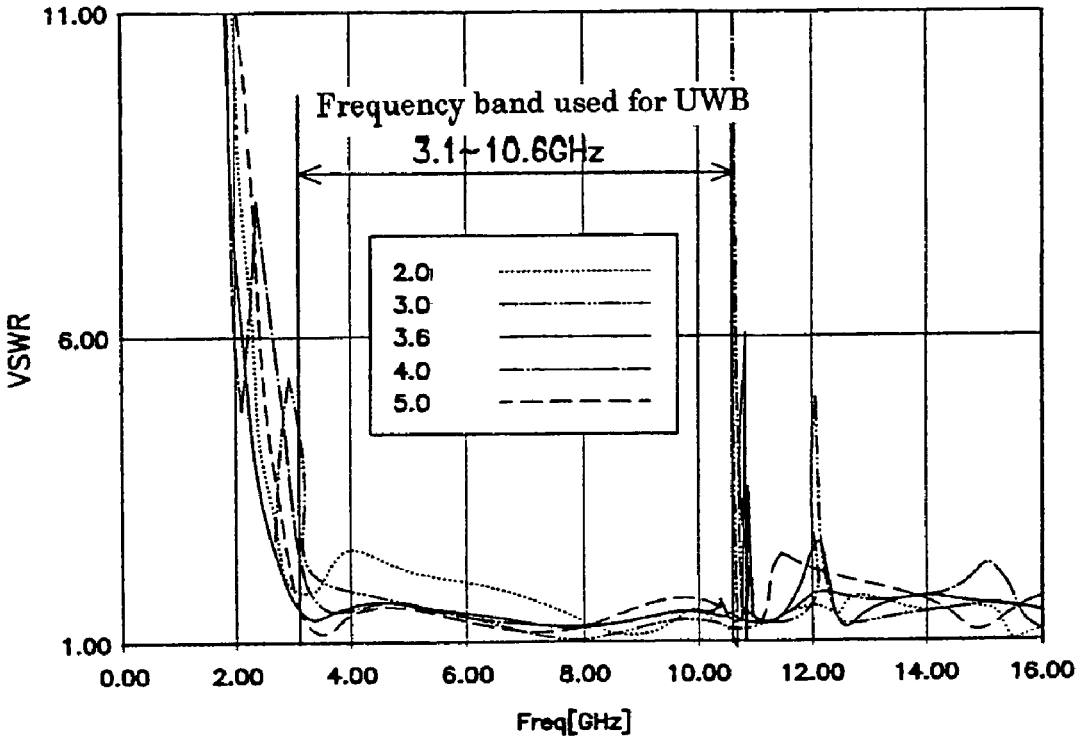
FIG. 18 is a graph showing the simulation result of the case that the relative permittivity is varied.

In order to make the antenna small, it is conceivable to make the relative permittivity of the dielectric member 118 large. The following is a description of a simulation, in which the relative permittivity was varied from this viewpoint. FIG. 18 is a graph showing the simulation result of the case that the relative permittivity is varied. According to this graph, the best results are attained when the relative permittivity is 3.6, and results that are substantially as favorable are also attained at 4.0.

From the various simulations and experiments described above, it was found that a biconical antenna 110*a* having a dielectric member 118 between a feeder portion 112*a* and a ground portion 114*a* has a performance desired for an antenna. In the frequency band used for UWB communication, the VSWR is not greater than 2, and for antennas this is a level suitable for practice. By providing the dielectric member 118, the antenna can be made smaller than conventional antennas. And by making it smaller, there is the big advantage that the space that it takes up when attached to a computer or the like is small.

The following is a description of a method for manufacturing the biconical antenna according to Embodiment 2, divided into Steps (1) to (5)

Step (1)

The feeder portion 112*a* and the ground portion 114*a* are obtained by machining a conductor into frustum shape or by forming electrodes punched out from a copper plate with a punch. It is also possible to form a frustum shape with resin or the like, and to cover its surface by electroless plating or the like.

Step (2)

A hole passing through the center of the conductor of the ground portion 114*a* is formed and the coaxial cable 124 is passed through this hole.

Step (3)

The center conductor 120 of the coaxial cable 124 is connected to the feeder portion 112*a*, and the shield conductor 122 is connected to the ground portion 114*a* within the hole. In this situation, the feeder portion 112*a* and the ground portion 114*a* are arranged such that their apex portions are coaxially and symmetrically in opposition to one another. Also, the feeder portion 112*a* and the ground portion 114*a* are arranged such that there is a predetermined gap 116*a* between them.

Step (4)

The dielectric member is filled between the feeder portion 112*a* and the ground portion 114*a*. A method for filling the dielectric member 118 is to put an intermediate product made by Steps (1) to (3) into a tubular container, and to solidify a molten dielectric material that is flowed into the tubular container. In this situation, it is preferable to perform defoaming through evacuation, such that there is no air in the dielectric member 118. In other words, defoaming casting is performed. Next, the intermediate product of the solidified dielectric member 118 is taken from the tubular container, portions of the dielectric member 118 are machined away, thus obtaining a cylindrical shape.

Step (5)

A connector 126 is connected to the coaxial cable 124, thus finishing the biconical antenna. It should be noted that Step (5) may also be performed prior to Step (4). In this manufacturing process, Step (4), which is the step of forming the dielectric member 118 has been added to the conventional process of manufacturing a biconical antenna. By adding Step (4), the advantage that the shape of the biconical antenna can be minimized is attained.

WORKING EXAMPLE 2

Working Example 2 relates to the case that the shapes of the feeder portion 112*b* and the ground portion 114*b* are different.

Figure 19:
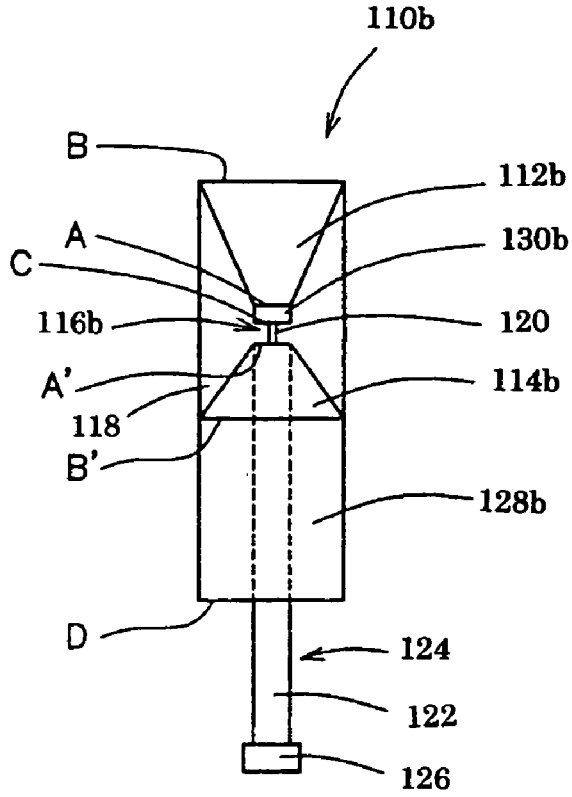
FIG. 19 is a diagram showing the configuration of a biconical antenna in which the height of the feeder portion 112*b* is different from the height of the ground portion 114*b*.

FIG. 19 is a diagram showing the configuration of a biconical antenna in which the height of the feeder portion 112*b* is different from the height of the ground portion 114*b*. The height of the frustum-shaped feeder portion 112*b* is higher than the height of the frustum-shaped ground portion 114*b*. Moreover, the apex portion A of the feeder portion 112*b* is provided with a reflector 130*b*. The reflector 130*b* is disk-shaped. This reflector 130*b* has the function of smoothly cutting high-frequency components. It should be noted that a configuration without the reflector 130*b* is also possible. Furthermore, there is a ground reinforcement portion 128*b* that is connected to the bottom portion B' of the ground portion 114*b*. The diameter of the bottom portion B' of the ground portion 114*b* is the same as the diameter of the ground reinforcement portion 128*b*, for example. The ground reinforcement portion 128*b* compensates the fact that the height of the ground portion 114*b* is lower than the height of the feeder portion 112*b*, so that the capacitance as ground is lowered.

The following is an example of the shape and dimensions of this biconical antenna. The diameters of the bottom portions B and B' of feeder portion 112*b* and the ground portion 114*b* are both 11.0 mm, and the diameters of the apex portions A and A' of the feeder portion 112*b* and the ground portion 114*b* are both 2.8 mm. The height of the feeder portion 112*b* is 8.0 mm, whereas the height of the ground portion 114*b* is 5.0 mm. The diameter of the reflector 130*b* is 2.8 mm and its height is 1.0 mm. The height of the ground reinforcement portion 128*b* is 13.0 mm. The relative permittivity of the dielectric member 118 is 3.6. Compared to the biconical antenna according to Working Example 1, the biconical antenna of this Working Example 2 has an overall larger height, but has a smaller diameter.

Figure 20:
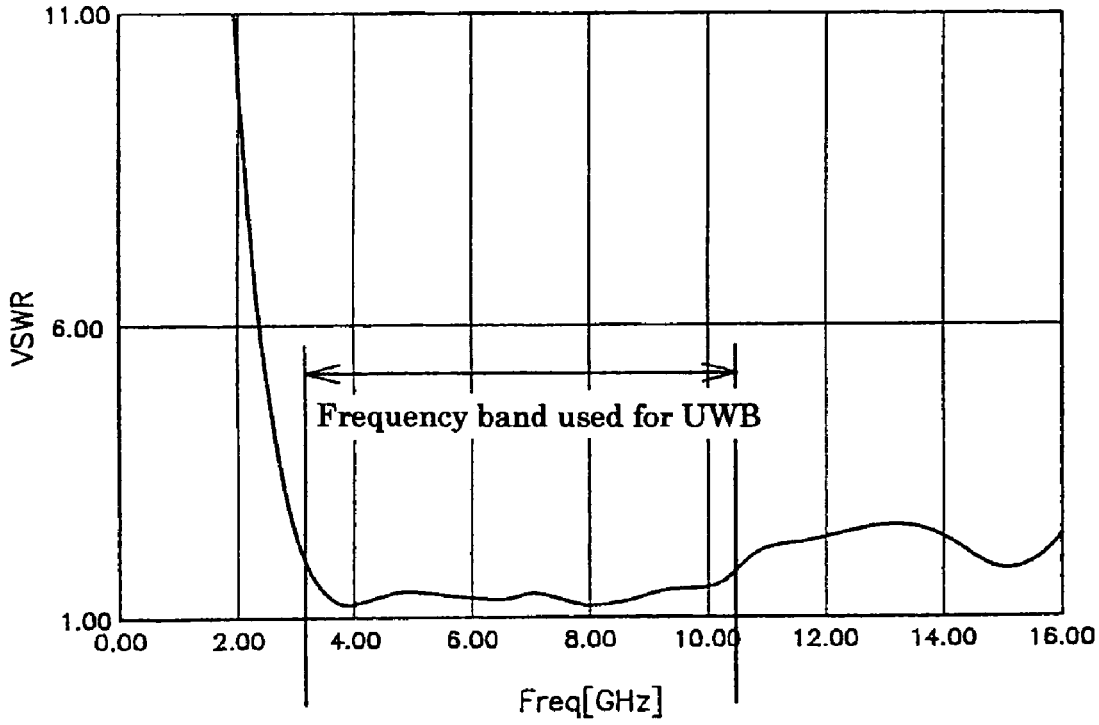
FIG. 20 is a graph showing the VSWR simulation results for the biconical antenna according to Working Example 2 of the second embodiment.

FIG. 20 is a graph showing the VSWR simulation results for the biconical antenna according to Working Example 2. This simulation is for the case that the coaxial cable 124 does not protrude from the bottom portion D of the ground reinforcement portion 128*b*. In the frequency region used for UWB, the VSWR is not greater than 2. And outside the frequency region used for UWB, the VSWR becomes high. In particular near 3.1 GHz, the VSWR increases sharply, and it can be seen that the antenna can be used only in the frequency band, which is advantageous for the antenna characteristics. Moreover, the antenna is compact and does not use a lot of space.

Figure 21:
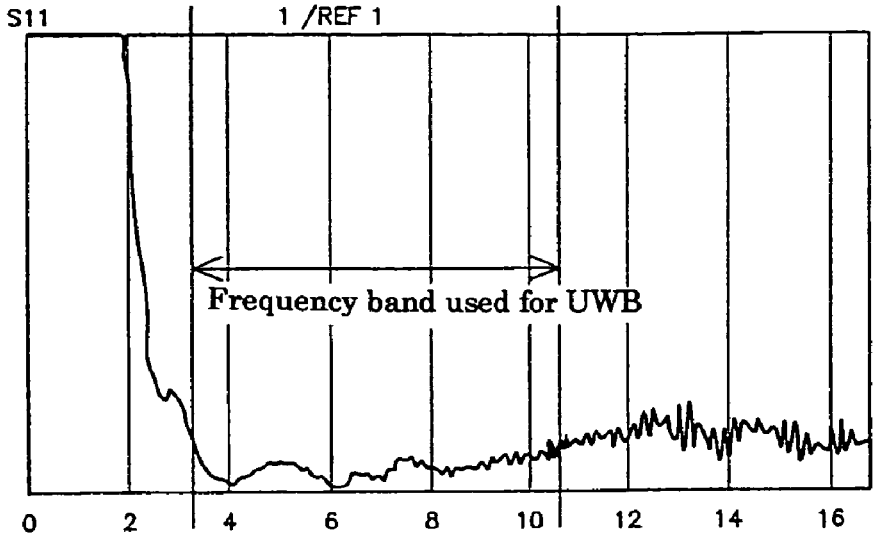
FIG. 21 is a graph showing the VSWR values of a biconical antenna 110*b* that was actually fabricated, having the same shape and dimensions as the biconical antenna serving as the basis of the simulation in FIG. 20.

FIG. 21 is a graph showing the VSWR values of a biconical antenna 10*b* that was actually fabricated, having the same shape and dimensions as the biconical antenna serving as the basis of the simulation in FIG. 20. The length of the coaxial cable 124 is terminated at 30 to 40 mm from the bottom portion D of the ground reinforcement portion 128*b*. As for the actually measured VSWR, similar results as for the simulation are attained, and it can be seen that it is favorable as an antenna.

The optimum shape and dimensions were determined by carrying out various simulations while varying a portion of the shape and dimensions. The following is a discussion of this.

Figure 22:
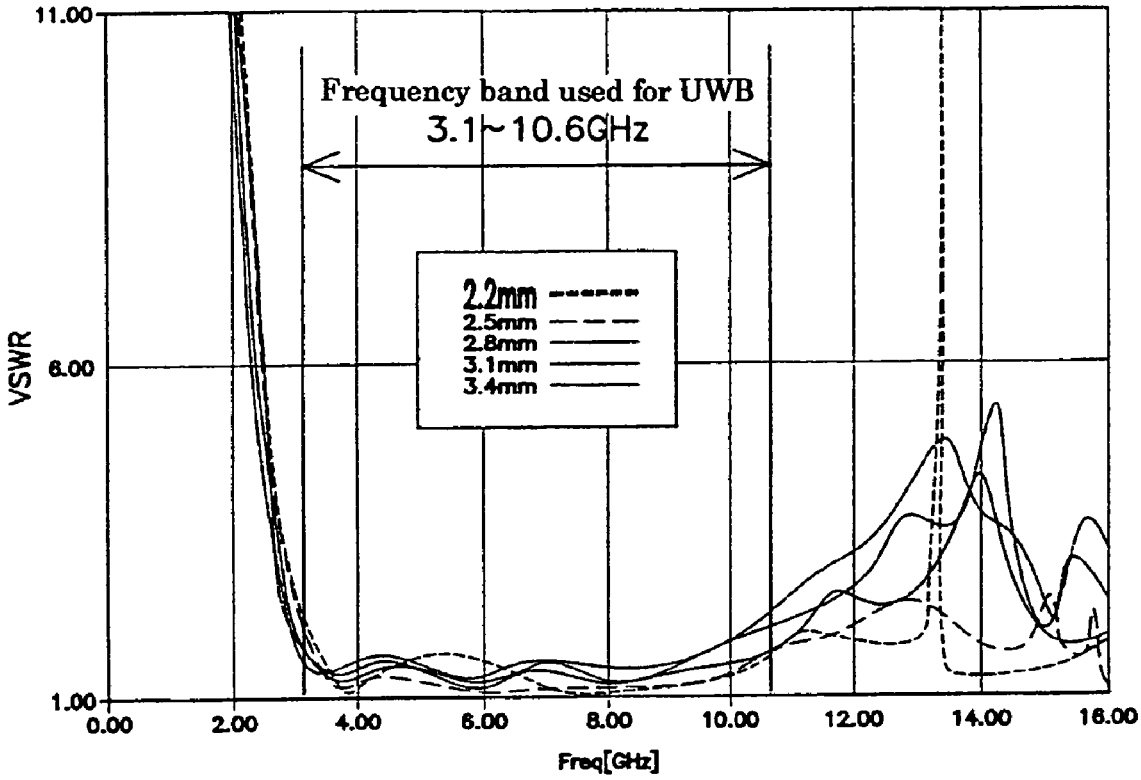
FIG. 22 is a graph showing the VSWR simulation result for the case that the dimension of the gap 116*b* of the biconical antenna 110*b* is varied.

FIG. 22 is a graph showing the VSWR simulation result for the case that the dimension of the gap 116*b* of the biconical antenna 110*b* is varied. The best antenna characteristics are attained when the gap 116*b* is 2.8 mm. When the gap 116*b* is 2.2 mm or 3.4 mm, the VSWR becomes larger than 2 in a low-frequency or high-frequency region, and the antenna characteristics deteriorate.

Figure 23:
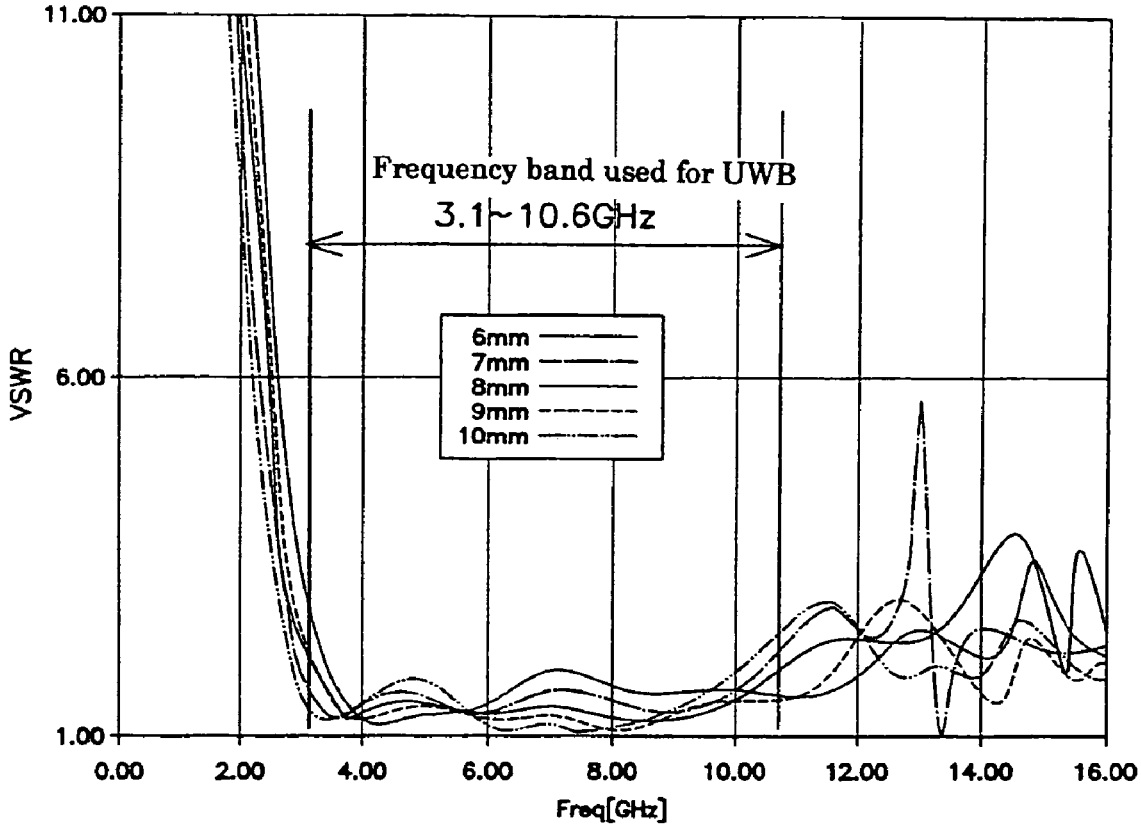
FIG. 23 is a graph showing the VSWR simulation result for the case that the height of the feeder portion 112*b* of the biconical antenna 110*b* is varied.

FIG. 23 is a graph showing the VSWR simulation result for the case that the height of the feeder portion 112*b* of the biconical antenna 110*b* is varied. The best antenna characteristics are attained when the height of the feeder portion 112*b* is 8 mm. It can be seen that when the height of the feeder portion 112*b* is 6 mm or 10 mm, the VSWR becomes larger than 2 in a low-frequency or high-frequency region, and the antenna characteristics deteriorate. Moreover, it can be seen that the antenna characteristics are changed drastically by a change in height of several millimeters.

Figure 24:
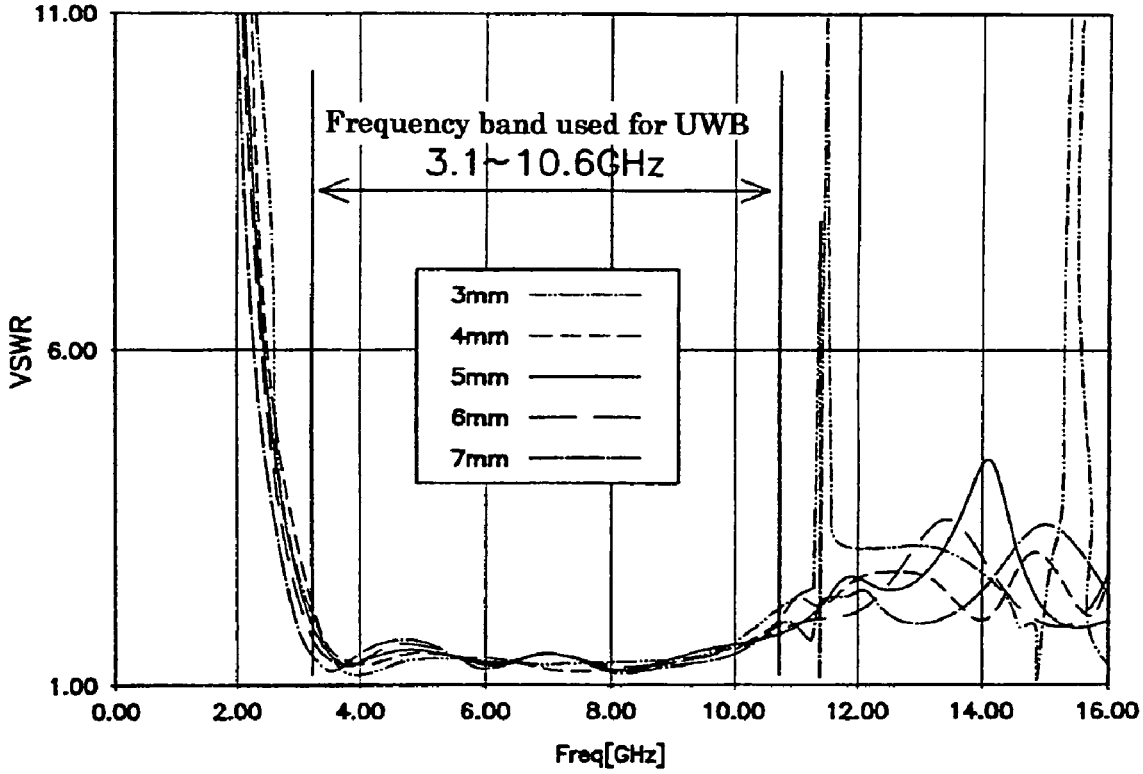
FIG. 24 is a graph showing the VSWR simulation result for the case that the height of the ground portion 114*b* of the biconical antenna 110*b* is varied.

FIG. 24 is a graph showing the VSWR simulation result for the case that the height of the ground portion 114*b* of the biconical antenna 110*b* is varied. The best antenna characteristics are attained when the height of the ground portion 114*b* is 5 mm. When the height of the ground portion 112*b* is 4 mm or less or 6 mm or more, then the value off the VSWR becomes large near 3.1 GHz, and the antenna characteristics deteriorate.

Figure 25:
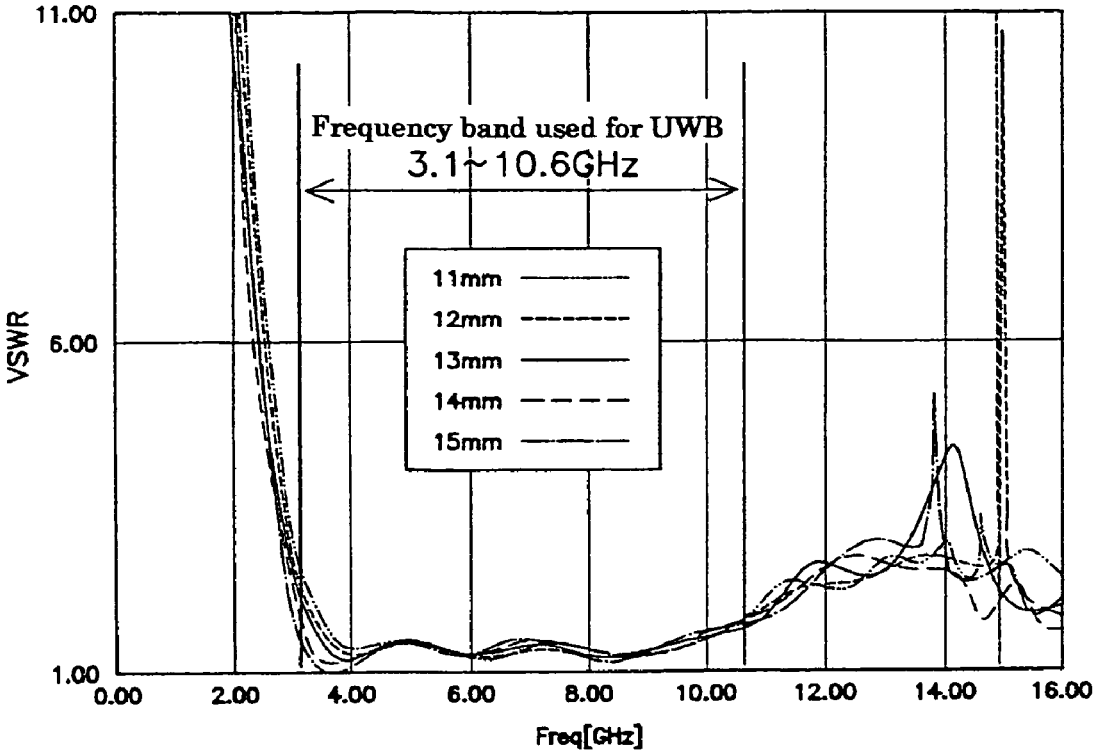
FIG. 25 is a graph showing the VSWR simulation result for the case that the height of the ground reinforcement portion 128*b* of the biconical antenna 110*b* is varied.

FIG. 25 is a graph showing the VSWR simulation result for the case that the height of the ground reinforcement portion 128*b* of the biconical antenna 110*b* is varied. Good antenna characteristics are attained when the height of the ground reinforcement portion 128*b* is 13 mm to 15 mm. When the height of the ground reinforcement portion 128*b* is 11 mm, the VSWR becomes greater than 2 at low frequencies, and the antenna characteristics deteriorate. In view of making the antenna small, a height of 13 mm is suitable.

Figure 26:
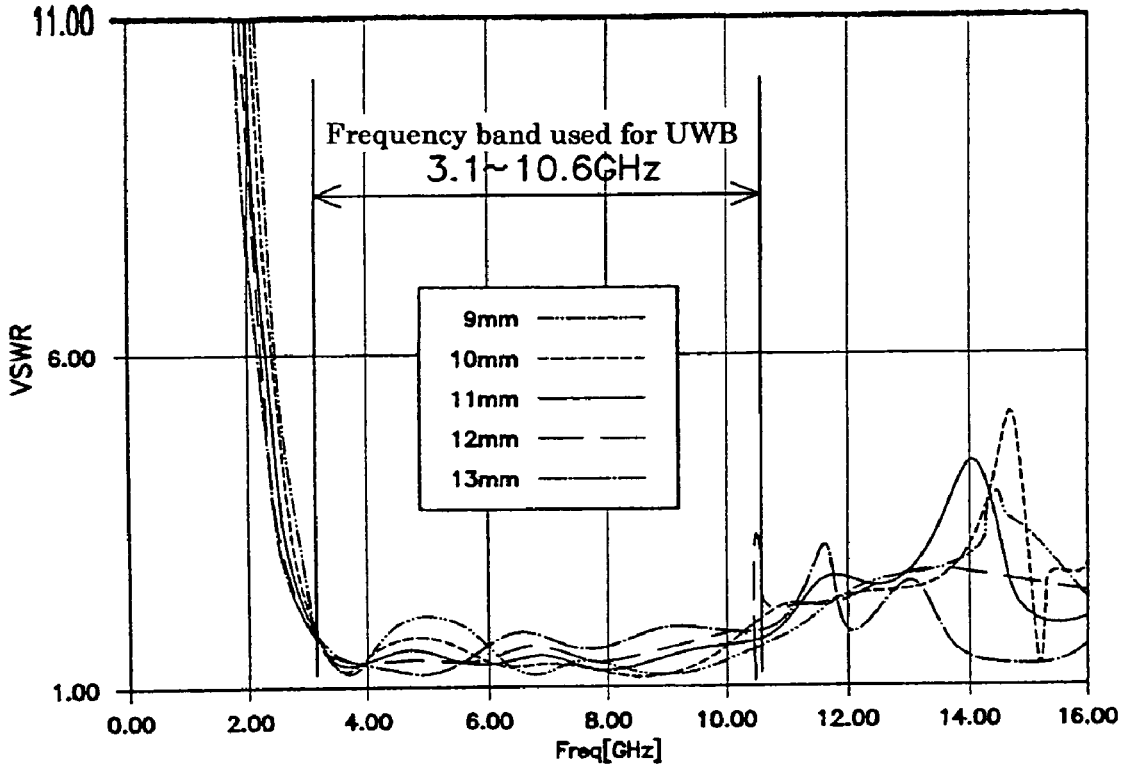
FIG. 26 is a graph showing the VSWR simulation result for the case that the diameter of the bottom portions B and B' of the feeder portion 112*b* and the ground portion 114*b*, which is the width of the biconical antenna 110*b*, is varied.

FIG. 26 is a graph showing the VSWR simulation result for the case that the diameter of the bottom portions B and B' of the feeder portion 112*b* and the ground portion 114*b*, which is the width of the biconical antenna 110*b*, is varied. When this diameter is 11 mm or 12 mm, then the VSWR is less than 2, and the antenna characteristics are favorable. In view of making the antenna small, it is preferable that this diameter is 11 mm.

Figure 27:
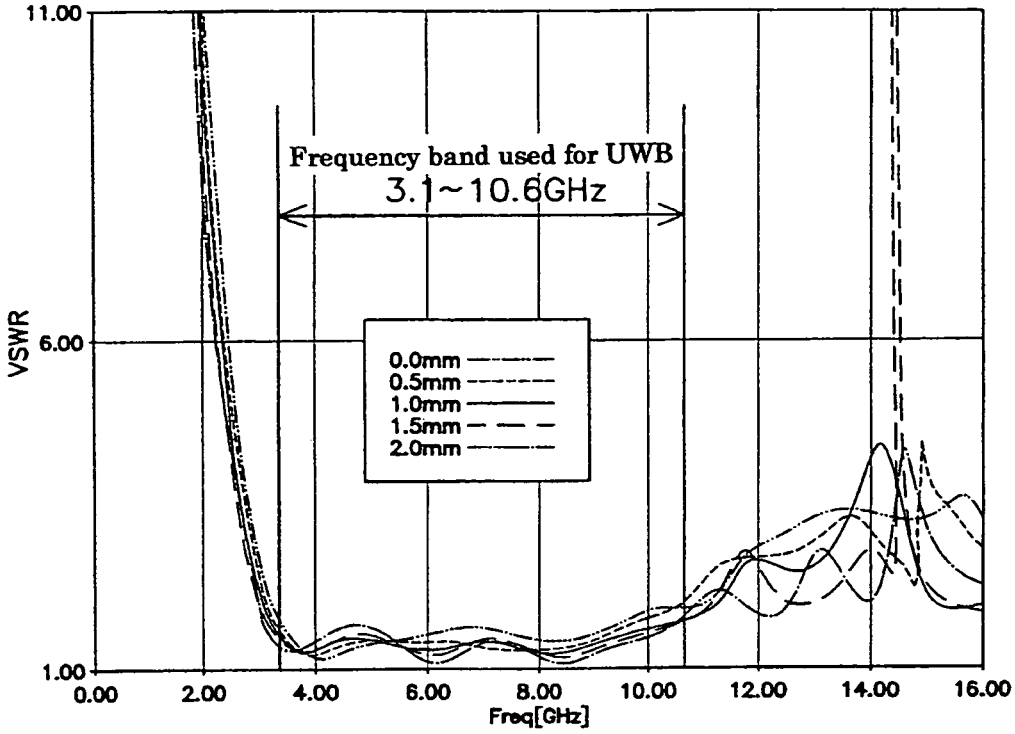
FIG. 27 is a graph showing the VSWR simulation result for the case that the height of the reflector 130*b* of the biconical antenna 110*b* is varied.

FIG. 27 is a graph showing the VSWR simulation result for the case that the height of the reflector 130*b* of the biconical antenna 110*b* is varied. It can be seen that the high frequency region can be cut through the reflector 130*b*. It can also be seen that at a location removed from the frequency region used for UWB, the VSWR becomes greater than 2, and frequencies that are not needed are cut. When the height of the reflector 130*b* is 1.0 mm or 1.5 mm, the antenna characteristics are favorable. In view of making the antenna small, it is preferable that this height is 1.0 mm.

Figure 28:
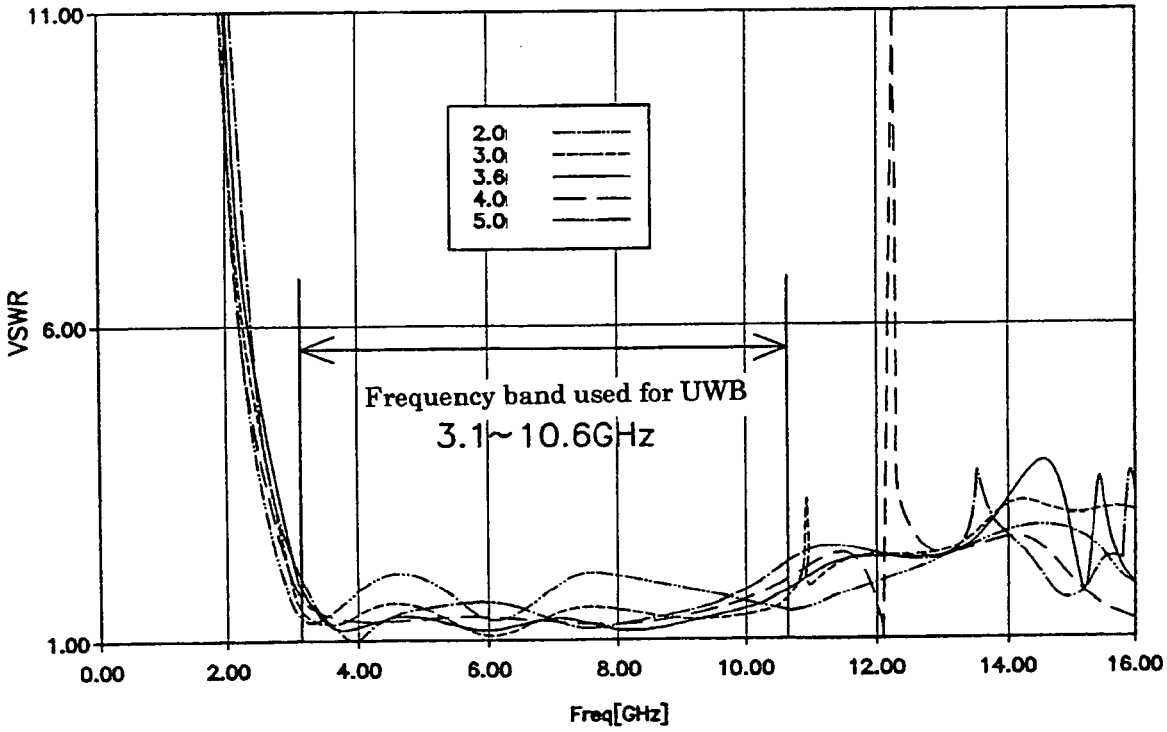
FIG. 28 is a graph showing the VSWR simulation result for the case that the relative permittivity of the dielectric member 118 is varied.

FIG. 28 is a graph showing the VSWR simulation result for the case that the relative permittivity of the dielectric member 118 is varied. The antenna characteristics are best when the relative permittivity is 3.6, but the antenna characteristics are also favorable when the relative permittivity is 3.0 or 4.0.

From the foregoing, it can be seen that the biconical antenna 110*b* can be made compact by using different heights for the feeder portion 112*b* and the ground portion 114*b*. This is advantageous when such a compact biconical antenna 110*b* is attached to a computer or its peripheral device.

WORKING EXAMPLE 3

Working Example 3 is based on the biconical antenna 110*a* of Working Example 1, and is provided with a reflector 130*c*.

Figure 29:
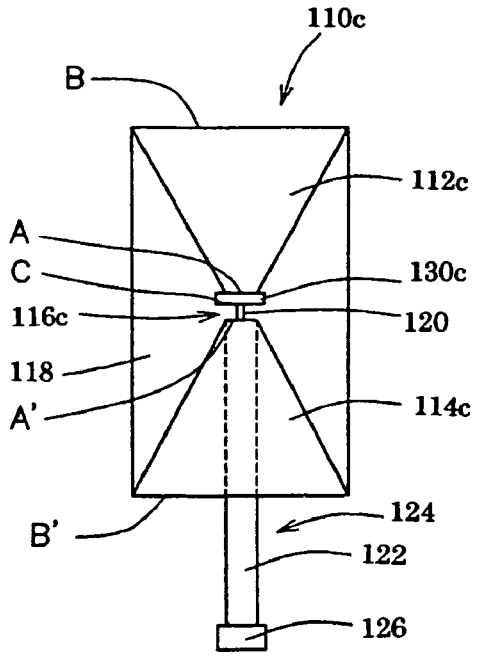
FIG. 29 is a diagram showing the configuration of an antenna in which the biconical antenna 110*a* of Working Example 1 of the second embodiment is provided with a reflector 130*c*.

FIG. 29 is a diagram showing the configuration of an antenna in which the biconical antenna 110*a* of Working Example 1 is provided with a reflector 130*c*. The reflector 130*c* is provided at the apex of the feeder portion 112*c*. The reflector 130*c* is disk-shaped. The height of the reflector 130*c* is 1 mm.

Figure 30:
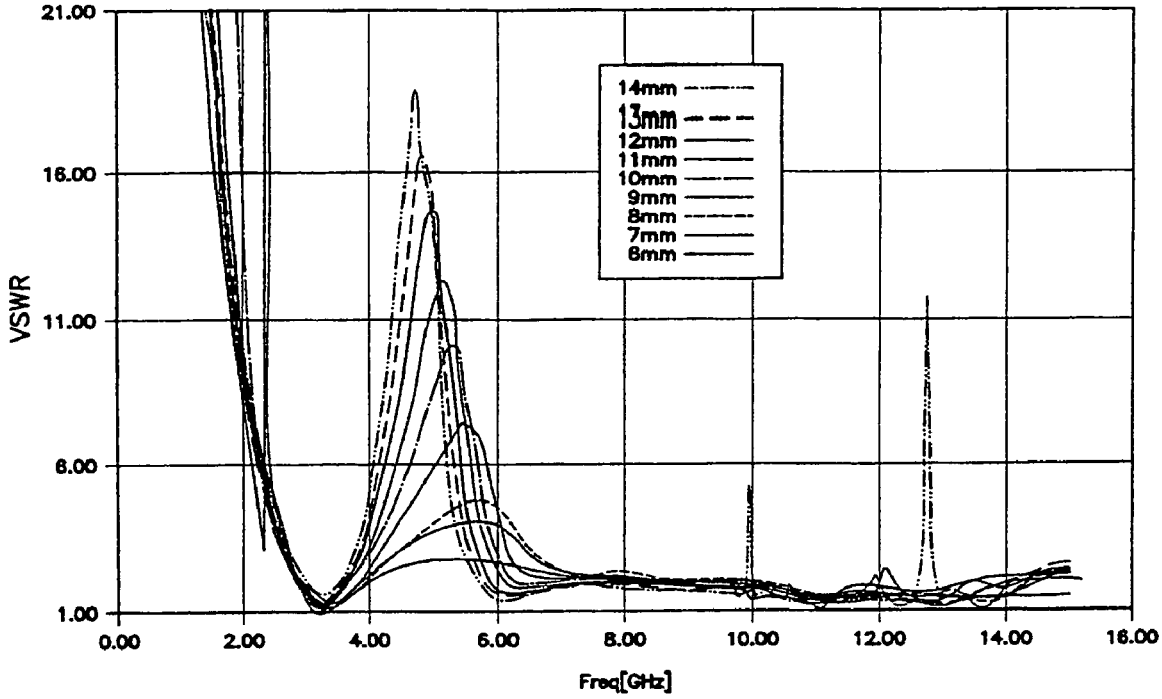
FIG. 30 is a graph showing the VSWR simulation results when varying the diameter C of the reflector 130*c*.

FIG. 30 is a graph showing the VSWR simulation results when varying the diameter C of the reflector 130*c*. From this graph, it can be seen that a band-stop filter can be configured by providing the reflector 130*c*. Thus, the effect is achieved that if the desired frequencies can be cut by the reflector 130*c*, it is not necessary anymore to provide the antenna 110*c* with a separate band-stop filter.

WORKING EXAMPLE 4

Embodiment 4 is based on the biconical antenna 110*b* of Working Example 2, and relates to the case that the diameter C of the reflector 130*d* is varied.

Figure 31:
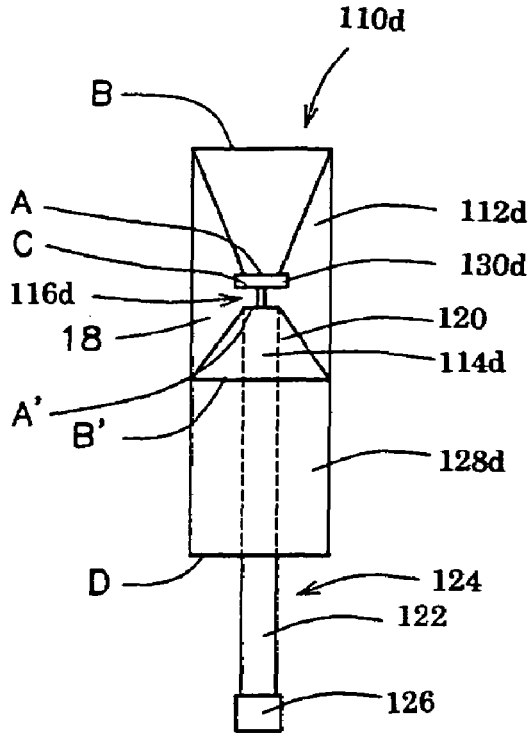
FIG. 31 is a drawing showing the configuration of an antenna for the case that the biconical antenna 110*b* of Working Example 2 is provided with a reflector 130*d*, and the diameter C of the reflector 130*d* is varied.

FIG. 31 is a drawing showing the configuration of an antenna for the case that the biconical antenna 110*b* of Working Example 2 is provided with a reflector 130*d*, and the diameter C of the reflector 130*d* is varied.

Figure 32:
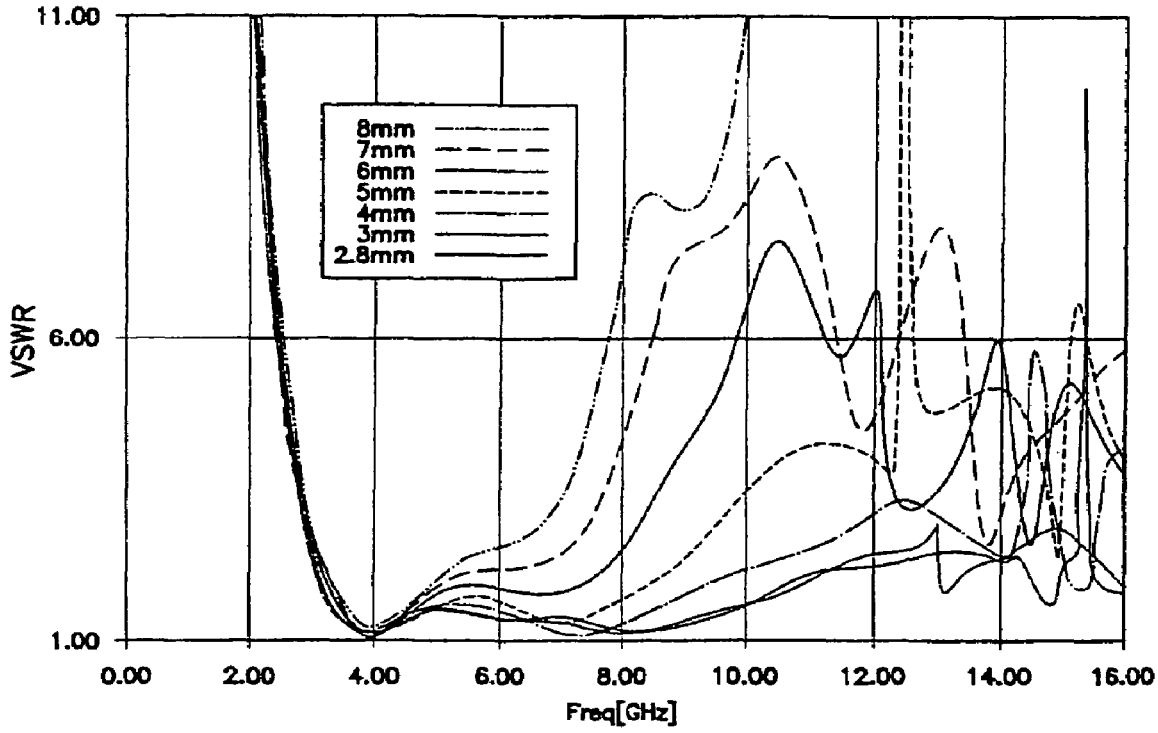
FIG. 32 is a graph showing the VSWR simulation result for the case that the biconical antenna 110*b* of Working Example 2 is provided with a reflector 130*d*, and the diameter C of the reflector 130*d* is varied.

FIG. 32 is a graph showing the VSWR simulation result for the case that the biconical antenna 110*b* of Working Example 2 is provided with a reflector 130*d*, and the diameter C of the reflector 130*d* is varied. From this graph, it can be seen that by providing the reflector 130*d*, high frequencies of more than 5 GHz can be cut. If a high frequency region is to be cut, then it is not necessary to further connect the antenna 110*d* to a band-stop filter, if the biconical antenna 110*d* of FIG. 31 is used.

Working Example 3 and Working Example 4 show that predetermined frequencies can be cut by the reflector 130*c* and the reflector 130*d*. Thus, it could be confirmed that the effect is attained that there is no necessity to provide the biconical antenna with a separate band-stop filter. Thus, in actual circuit design, it is also possible to cut specific frequencies by providing a biconical antenna with the reflector 130*c* or the reflector 130*d*, but it is also possible to cut specific frequencies by adding separate circuitry to the biconical antenna, thus allowing for more flexibility in the design of antennas and circuits.

In Working Example 1 to Working Example 4, various experiments and simulations have been carried out. In accordance with the present invention, by providing a dielectric member 118, the fact that the relative permittivity of the dielectric member is larger than the relative permittivity of air is utilized to enable miniaturization of the antenna. Through this miniaturization, it becomes easy to attach the antenna to a computer or the like, and the high-speed exchange of large amounts of data becomes possible without using a cable. Moreover, through these various experiments and simulations, it has become possible to provide a biconical antenna that is compact and that has optimal antenna characteristics.

While the invention has been described in detail, the foregoing description is in all aspects illustrative and not restrictive. It is understood that numerous other modifications and variations can be devised without departing from the scope of the invention.

What is claimed is:

1. A biconical antenna, comprising:

a frustum-shaped feeder portion having a flat surface at its apex, wherein a conductor is formed at least on its surface;

a frustum-shaped ground portion having a flat surface at its apex, wherein a conductor is formed at least on its surface, the ground portion being arranged in opposition to the feeder portion, such that a gap is provided between the flat surfaces, the frustum shapes of the feeder portion and the ground portion have different heights, the frustum shape of the feeder portion is higher than the frustum shape of the ground portion;

a ground reinforcement portion that is made of cylindrical conductor and connected to a bottom portion of the frustum-shaped ground portion; and a dielectric member filling a space between the feeder portion and the ground portion.

2. The biconical antenna according to claim 1, wherein the apex of the feeder potion is provided with a disk-shaped reflector.

3. The biconical antenna according to claim 2, wherein the diameter of the disk-shaped reflector depends on a frequency to be cut.

4. The biconical antenna according to claim 2, wherein the relative permittivity of the dielectric member is in the range of 3.55 to 3.65.

5. The biconical antenna according to claim 1, wherein the dielectric member is epoxy resin.

6. The biconical antenna according to claim 3, wherein the dielectric member is epoxy resin.

* * * * *